US006876277B2

(12) United States Patent
Cooper

(10) Patent No.: US 6,876,277 B2
(45) Date of Patent: Apr. 5, 2005

(54) E-PLANE FILTER AND A METHOD OF FORMING AN E-PLANE FILTER

(75) Inventor: Michael Cooper, Aylmer (CA)

(73) Assignee: Dragonwave, Inc., Kanata (CA)

( * ) Notice: Subject to any disclaimer, the term of this patent is extended or adjusted under 35 U.S.C. 154(b) by 0 days.

(21) Appl. No.: 10/325,749

(22) Filed: Dec. 23, 2002

(65) Prior Publication Data

US 2003/0117243 A1 Jun. 26, 2003

Related U.S. Application Data

(60) Provisional application No. 60/342,132, filed on Dec. 26, 2001.

(51) Int. Cl.[7] ..... H01P 1/208; H01P 11/00

(52) U.S. Cl. ..... 333/208; 333/212; 333/249

(58) Field of Search ..... 333/135, 208, 333/209, 210, 212, 239, 249

(56) References Cited

U.S. PATENT DOCUMENTS 6,181,224 B1 1/2001 Glinder ..... 333/208

FOREIGN PATENT DOCUMENTS

| | | | |
|---|---|---|---|
| JP | 57041702 | 3/1982 | ..... G05B/9/02 |
| JP | 57070942 | 5/1982 | ..... F02M/9/06 |
| WO | 9301625 | 1/1993 | ..... H01P/1/208 |
| WO | WO 01/54272 * | 7/2001 | |

* cited by examiner

*Primary Examiner*—Stephen E. Jones

(57) ABSTRACT

An E-plane filter comprises a housing having a waveguide filter channel and a septum defining a plurality of couplers spaced apart along the length of the filter channel, thereby forming a resonator cavity between each adjacent coupler. The portion of the filter channel which accommodates the couplers and each resonator cavity is curved or otherwise changes direction in a plane transverse to the channel walls.

52 Claims, 12 Drawing Sheets

E-PLANE FILTER AND A METHOD OF FORMING AN E-PLANE FILTER

This application claims the benefit of U.S. provisional application No. 60/342,132 filed Dec. 26, 2001.

FIELD OF THE INVENTION

The present invention relates to E-plane filters, and in particular, but not limited to E-plane filters for microwave receivers and transmitters.

BACKGROUND OF THE INVENTION

Radio transmitters and receivers require filters to remove or suppress unwanted frequencies from being transmitted or received. The transmitter portion of the radio may generate frequencies which will interfere with the radio system, or which may be prohibited by the radio frequency spectrum governing body. The receiver may need to suppress unwanted signals at different frequencies generated by the transmitter, or received from an external source, which would adversely affect the performance of the receiver.

At millimetre-wave frequencies, sources of unwanted frequencies include the local oscillator frequency, image frequencies from the mixer, and the transmitter frequencies in the case of the receiver. The frequencies generated by the mixer and the local oscillator are functions of the selected radio architecture. The closer the oscillator frequency (or its harmonics) is to the transmitter frequencies, the more difficult it is to remove the undesired frequency. However, to operate at wider spaced frequencies may require more complex circuitry, resulting in a more expensive radio implementation. A small separation between the transmit and receive frequencies can result in unwanted high power transmit frequencies leaking into the receiver. The separation between the transmit and receive frequencies is usually specified by the licensing bodies and the system operators. The radio designer may not have control over this specification.

To suppress the unwanted frequencies below an acceptable power level, a filter element is required in the signal path. The filter element discriminates between the desired and undesired frequencies based on the wavelengths of the signals. A common millimetre-wave filter is based on the metal waveguide.

Waveguide filters are used at microwave frequencies due to their low loss characteristics. Low loss in the resonant sections corresponds to a higher-Q, faster rolloff outside the passband and lower transmission loss in the passband. A typical waveguide filter consists of multiple coupled resonators, where the volume of a resonator is proportional to the frequency of operation.

An example of a conventional waveguide filter comprises a housing containing a series of resonator cavities arranged in a straight line, where adjacent resonator cavities are separated by an apertured partition which forms a coupler. The resonator cavities are typically rectangular or cylindrical and have a length corresponding to one half wavelength or multiples of one half wavelength of the centre frequency.

Another implementation of a waveguide filter is the E-plane filter, an example of which is shown in FIGS. 1A and 1B. Referring to FIGS. 1A and 1B, the waveguide filter 1 includes a filter housing 2 which forms an elongate channel 4. The housing is split into two parts 6, 8 along the length of the channel to receive an apertured thin metal sheet 10 therebetween. The apertured metal sheet 10 is called a septum.

The rectangular apertures 12 formed in the thin metal sheet 10 each define a resonator and the metal strips 14 remaining between the resonators function as couplers and are known as coupling sections. Each coupling section of the septum effectively divides the waveguide into two halt waveguides having a reduced width of less than half the center frequency wavelength so that the reduced size waveguide does not permit propagation of the electromagnetic wave.

In microwave communications at moderately high frequencies, for example carrier frequencies in the range of 24 to 31 GHz, the frequency band for each of the receive and transmit channels may have a width of only one percent of the center frequency and the center frequencies may be separated by a frequency band of similar width. Thus, a waveguide filter suitable for such an application must provide a relatively narrow pass band with a sharp roll-off, and therefore such a filter requires a relatively large number of resonator cavities and coupling sections. One problem in conventional filter design is that as the number of resonators and coupling sections increases, the waveguide becomes longer and therefore requires a larger housing which adds to the cost and makes it difficult to integrate with other system components.

Various designs for a resonator cavity-type waveguide filter have been proposed to accommodate the resonators and couplers into a smaller space. For example, Japanese Patent Application No. 57041702, Publication No. JP-A-58161403 and Japanese Patent Application No. 57070942, Publication No. JP-A-58187001 each discloses a band pass filter having a series of coupled cylindrical resonator cavities, each centered at the corner of a square. This design takes advantage of the cylindrical symmetry of the resonators to permit the output coupler of each resonator to be oriented at 90° with respect to its input coupler.

U.S. Pat. No. 6,181,224 (Glinder) describes a resonator cavity-type waveguide filter having a series of resonator cavities interconnected by coupler channels in which opposite sides of the coupler channels are the same length, but opposite sides of the resonator cavities have different lengths, so that the input of each resonator cavity is angled relative to its output. In one example, a number of similar resonator cavities having dissimilar length sides are arranged to form an S-shaped waveguide which is accommodated in a space whose length is shorter than that needed for a linear waveguide having similar characteristics. The mechanical length of a resonator cavity having dissimilar length sides which determines the pass center frequency is based on the length of the arcuate center line through the resonator cavity between the input and output couplers. Due to the shape of the resonator cavity, the length of the curved center line is different from that of a linear resonator cavity and is calculated by first calculating the required mechanical length of a linear resonator cavity and then applying a correction factor to the mechanical length. The correction factor is calculated based on the guide wavelength for a linear resonator, the desired pass center wavelength for the non-linear cavity, the width of the waveguide and the radius of curvature of the center line. Although the design disclosed in U.S. Pat. No. 6,181,224 allows the length of a waveguide filter to be reduced, it may be difficult to implement a high-Q, narrow pass band filter using this design since the required dimensions of the filter become more difficult to calculate as the number of cavities increases.

SUMMARY OF THE INVENTION

According to a first aspect of the present invention, there is provided an E-plane filter comprising a housing having a waveguide filter channel formed therein, first and second couplers extending between opposed first and second walls of the waveguide filter channel and spaced apart along the channel to form a resonator cavity therebetween, wherein the waveguide channel changes direction in a plane transverse to the first and second walls, and within a portion of the filter channel which accommodates the first and second couplers and the resonator cavity therebetween.

Advantageously, this arrangement allows an E-plane filter to be accommodated within a waveguide housing which is shorter than that required to accommodate a linear E-plane waveguide filter. In contrast to a linear E-plane filter, this arrangement also allows the waveguide input and output to be positioned independently of one another. A further benefit of this arrangement in comparison to a resonator cavity-type waveguide filter is that since the width of the channel in an E-plane filter is less than half a wavelength of the center frequency, whereas, for the same frequency, the width of the cavity in a resonator cavity-type waveguide filter is greater than half a wavelength, the channel in the E-plane filter may turn more tightly, allowing the filter to be accommodated in a smaller space. A further advantage of this arrangement is that the channel may turn at any position along its length irrespective of whether the turn is positioned within a resonator, a coupler, or at least partially extends through one or the other or bridges both.

In one embodiment, the channel changes direction within the length of the resonator cavity and/or the channel changes direction within the portion of the channel which contains at least one coupler.

In a particularly advantageous embodiment, the change in direction of the channel is defined by a curve in the first and second walls. The inventor has discovered that, surprisingly, the electrical characteristics of a resonator in an E-plane filter accommodated in a curved channel, in which the radius of curvature of the centre line along the channel is about twice the centre frequency wavelength or more, has substantially the same characteristics as a resonator accommodated within the same channel had it been linear, if the length of the curved center line, centered between the first and second walls, between the ends of the resonator in the curved channel is equal to the length of a resonator in the same but linear channel. Advantageously, this allows the required dimensions to provide the desired electrical and mode characteristics of a resonator which is to be accommodated in a curved channel to be easily and accurately determined without the need for applying complex correction factors which are required in designing a non-linear resonator cavity in a cavity-type waveguide filter.

In one embodiment, the portion of the waveguide channel which accommodates a resonator is part linear and part curved. Surprisingly, the characteristics of such a resonator are substantially the same for a resonator accommodated in the same but linear channel if the combined lengths of the center line through the curved and linear parts between the ends of the resonator are the same as the length of a resonator in the same but linear channel, where the radius of curvature of the centre line along the channel in the curved portion is about twice the centre frequency wavelength or more. Advantageously, this arrangement provides great flexibility in designing the path of a waveguide channel in that the portion of the channel accommodating a resonator may be entirely linear, entirely curved or part linear and part curved and the required dimensions of the resonator which yield the desired characteristics can be readily determined in all three cases without the need for complex and time consuming calculations.

In one embodiment, the channel changes direction about a curve defined by the first and second walls wherein the curved portion of the channel accommodates a coupler of the E-plane filter. A further surprising discovery made by the inventor is that if a coupler is accommodated within a curved section of the channel, the characteristics of the coupler are substantially the same as for a coupler accommodated in the same but linear waveguide channel if the length of the curved center line, centered between the first and second walls, between the ends of the coupler in the curved section is equal to the length of a coupler in the same but linear waveguide channel, and the radius of curvature of the centre line along the channel is about twice the centre frequency wavelength or more. This discovery increases the flexibility with which the shape of the path of the waveguide channel in an E-plane filter can be configured and allows the channel to turn through a portion thereof which accommodates a coupling section, while at the same time allowing the dimensions of the coupling section required to yield the desired characteristics to be precisely determined without the need for complex and time consuming calculations.

Advantageously, the positioning of a coupler (which may alternatively be referred to as a coupling member or coupling section) within a curved portion of channel allows the path between adjacent resonators to turn in a smaller space in comparison to the cavity-type filter disclosed in U.S. Pat. No. 6,181,224 in which the coupling channels are linear.

In one embodiment, the portion of the waveguide channel which accommodates a coupling section is part curved and part linear. The inventor has further discovered that the characteristics of a coupler which are accommodated in a channel which is part curved and part linear is substantially identical to the characteristics of a coupler accommodated within the same but linear channel, if the combined lengths of the curved and linear center lines centered along the part curved, part linear channel, between the opposed ends of the coupling section are equal to the length of the center line between opposed ends of a coupler accommodated within the same but linear channel, and if the curvature of the centre line along the channel is relatively gentle. For example, it has been found that the radius of curvature of the centre line along the channel may be about twice the centre frequency wavelength, or more. This discovery further increases the flexibility with which the waveguide channel path in an E-plane filter can be configured since a coupling section may be accommodated within a section of channel which is entirely linear, entirely curved or part linear and part curved and its dimensions to give the required characteristics can in all three cases be readily and precisely determined without complex and lengthy calculations.

In other embodiments, a portion of the channel which accommodates at least one of a resonator and a coupler is curved in a plane transverse to the first and second walls, wherein the curved portion of channel includes a first section of channel having a first radius of curvature and a second section of channel having a second radius of curvature different from the first radius of curvature. Advantageously, the inventor has further discovered that the characteristics of a resonator or coupling section of an E-plane filter accommodated within a portion of channel which is at least partially curved, where the radius of curvature is not constant, is substantially identical to the characteristics of a resonator or coupler accommodated within the same but linear channel, if the length of the center line, centered between the first and second walls of the channel, between the ends of the at least partially curved resonator or coupler is equal to the length of the center line between the ends of a resonator or coupler accommodated within the same but linear channel, and where the curvature of the centre line is relatively gentle, for example, the radius of curvature of the centre line along the channel is about twice the operating frequency wavelength, or more. Advantageously this discovery further increases the flexibility with which an E-plane filter can be designed, by allowing the channel within which a resonator or coupler is accommodated to have different radii of curvature in part or all of the length of the resonator or coupler while allowing the dimensions of the resonator or coupler required to give the desired characteristics to be easily and precisely determined without the need for complex calculations.

According to another aspect of the present invention, there is provided first and second E-plane filters, each E-plane filter comprising a housing having a waveguide channel formed therein, first and second couplers extending between opposed first and second walls of the channel and spaced apart along waveguide channel to form a resonator cavity therebetween, wherein the waveguide channel changes direction in a plane transverse to the first and second walls, the change of direction being defined by a curve in the first and second walls, at least a section of the curved portion of both channels being identical to one another and wherein the position of at least one of the first and second couplers of one E-plane filter relative to the curved portion is different from that of the respective coupler or couplers in the other E-plane filter.

Advantageously, the aforementioned discoveries enable E-plane filters having different frequency characteristics to be realized using a waveguide housing having a single design of non-linear waveguide channel. For example, a waveguide channel having a given radius of curvature may be used to accommodate a wide range of different frequency resonators. This use of the same non-linear waveguide channel for E-plane filters having different characteristics potentially provides a large saving in the cost of a filter since large numbers of different E-plane filters can be manufactured using the same casting to form the filter housing. Furthermore, depending on the quality of the casting, high quality E-plane filters having very precise and repeatable characteristics can be manufactured at low cost. The application-specific frequency characteristics of each filter are determined by the dimensions of the resonator and coupling sections of the septum which can be manufactured at low cost in fewer quantities.

According to another aspect of the present invention there is provided a septum for an E-plane filter, the septum defining a first coupler and a second coupler each having an end defining a gap for a resonator cavity therebetween, wherein the ends are angled relative to one another in the plane of the septum to form the ends of a resonator cavity to be accommodated in a channel which changes direction within the length of the resonator cavity.

Advantageously, this arrangement of septum can be accommodated in an E-plane filter having a waveguide channel which changes direction, for example about one or more turns or curves in the plane of the septum, allowing the waveguide to be accommodated within a housing whose dimension between the input and the output is shorter than that of a linear waveguide.

Preferably, opposed ends of the couplers are substantially linear.

In one embodiment, the ends of the couplers are angled such that the center line of a non-linear channel of an E-plane filter in which the resonator cavity between the opposed ends of the couplers is to be accommodated, intersects each of the ends substantially at right angles thereto. Advantageously, this feature allows the precise dimensions of the resonator for the desired frequency characteristics to be readily calculated, at least for waveguide channels in which the radius of a curvature of the centre line is about twice the operating frequency wavelength or more. In this case, the length of the center line between the ends of the resonator in the non-linear channel is equal to the length of a resonator accommodated in the same but linear channel required to give the desired frequency characteristics.

According to another aspect of the present invention, there is provided a septum for an E-plane filter, the septum defining a coupler having opposed ends which are angled relative to one another in the plane of the septum, whereby, in use, the coupler is accommodated in an E-plane filter having a channel which changes direction within the length of the coupler.

Preferably, the ends of the coupler are linear.

In one embodiment, the ends of the coupler are angled such that each end intersects the center line of a non-linear-channel of an E-plane filter in which the coupler is to be accommodated, at substantially right angles thereto.

Advantageously, this feature allows the precise dimensions of the coupler for the desired frequency characteristics to be readily calculated, at least for waveguides in which the radius of curvature of the centre line along the waveguide channel is about twice the operating frequency wavelength or more. In this case, the length of the center line between the ends of the coupler in the non-linear channel is equal to the length of a coupler accommodated in the same but linear channel required to give the desired frequency characteristics.

According to another aspect of the present invention, there is provided a method of forming a septum for an E-plane filter in which the filter has a waveguide channel which changes direction within the length of a resonator cavity, the method comprising the steps of: (1) determining the length of a gap between the ends of opposed coupling members based on an E-plane filter in which a resonator cavity between the coupler members is accommodated in a linear channel and (2) forming the ends of the opposed coupling members based on an E-plane filter having a waveguide channel that changes direction within the length of said resonator cavity such that the length of the center line along the waveguide channel between the ends of the couplers corresponds to the length of the gap determined in step (1).

In a preferred embodiment, the method further comprises forming the ends such that the ends are substantially linear.

Preferably, the ends are formed such that the ends intersect the center line substantially at right angles thereto.

According to a further aspect of the present invention, there is provided a method of forming a septum for an E-plane filter in which the filter has a waveguide channel which changes direction within the length of a coupler, the method comprising the steps of: (1) determining the distance between the opposed ends of a coupler based on an E-plane filter in which the coupler is accommodated within a linear channel, and (2) forming the ends of the coupler based on a waveguide having a channel that changes direction within the length of the coupler such that the length of the center line along the channel between the ends of the coupler corresponds to the distance between the ends determined in step (1).

Preferably, the method further comprises the step of forming the ends of the coupler such that the ends are substantially linear.

In a preferred embodiment, the method further comprises forming the ends of the coupler such that the ends intersect the center line substantially at right angles thereto.

According to another aspect of the present invention, there is provided an E-plane filter housing section having a waveguide channel formed therein, the waveguide channel having opposed first and second walls, wherein a portion of the waveguide channel which is to accommodate at least two couplers and a resonator cavity therebetween changes direction in a plane transverse to the first and second walls.

In a preferred embodiment the change in direction of the channel is defined by a curve in the first and second walls.

Preferably, the center of curvature of the curve is positioned external of the portion of the channel containing the curve so that, curvature is relatively gentle, for example, the radius of curvature of the centre line along the channel is about twice the longest operating frequency wavelength or more for which the waveguide is to be used, for ease of determining the dimensions of the septum for the required operating characteristics.

A further aspect of the present invention provides the use of two or more E-plane filter housing sections as defined above having the same channel configuration, in two or more E-plane filters having different lengths of resonator cavity and/or couplers.

According to a further aspect of the present invention, there is provided a cast for casting an E-plane filter housing section, wherein the cast includes a formation for casting a non-linear waveguide channel in the housing.

BRIEF DESCRIPTION OF THE DRAWINGS

Examples of embodiments of the present invention will now be described with reference to the drawings, in which.

DETAILED DESCRIPTION OF EMBODIMENTS

Figure 1A:
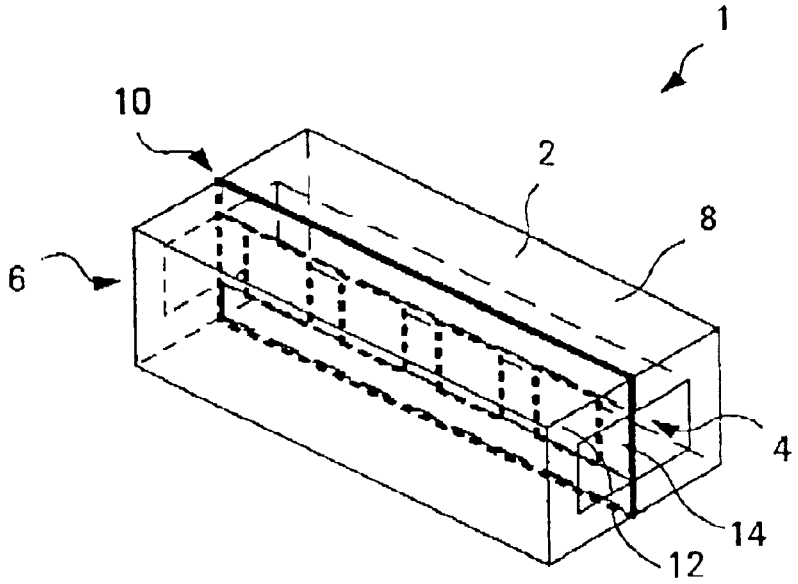
FIG. 1A (Prior Art)
FIG. 1 shows a perspective view of a linear E-plane filter according to the prior art.
Figure 1B:
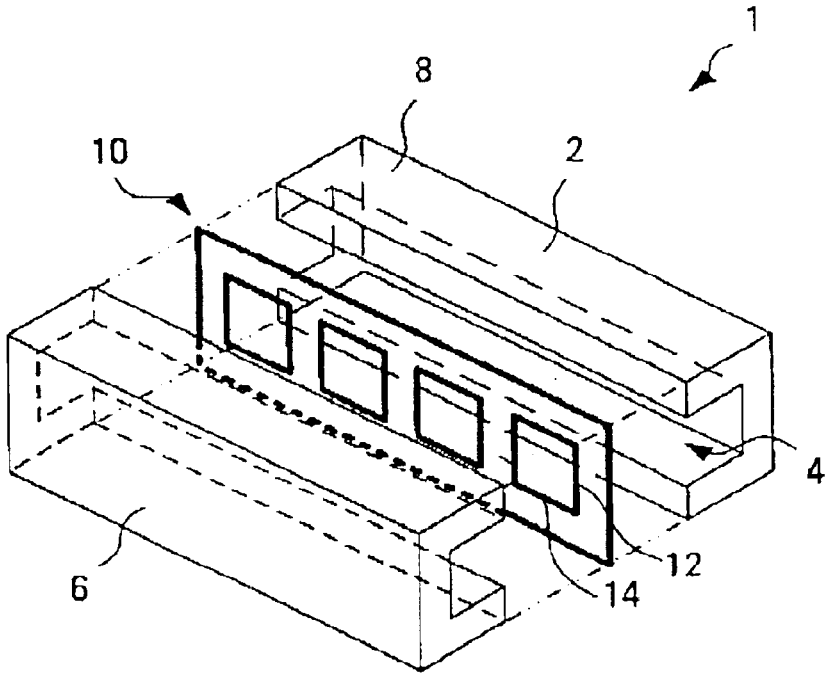
FIG. 1B (Prior Art)
Figure 2:
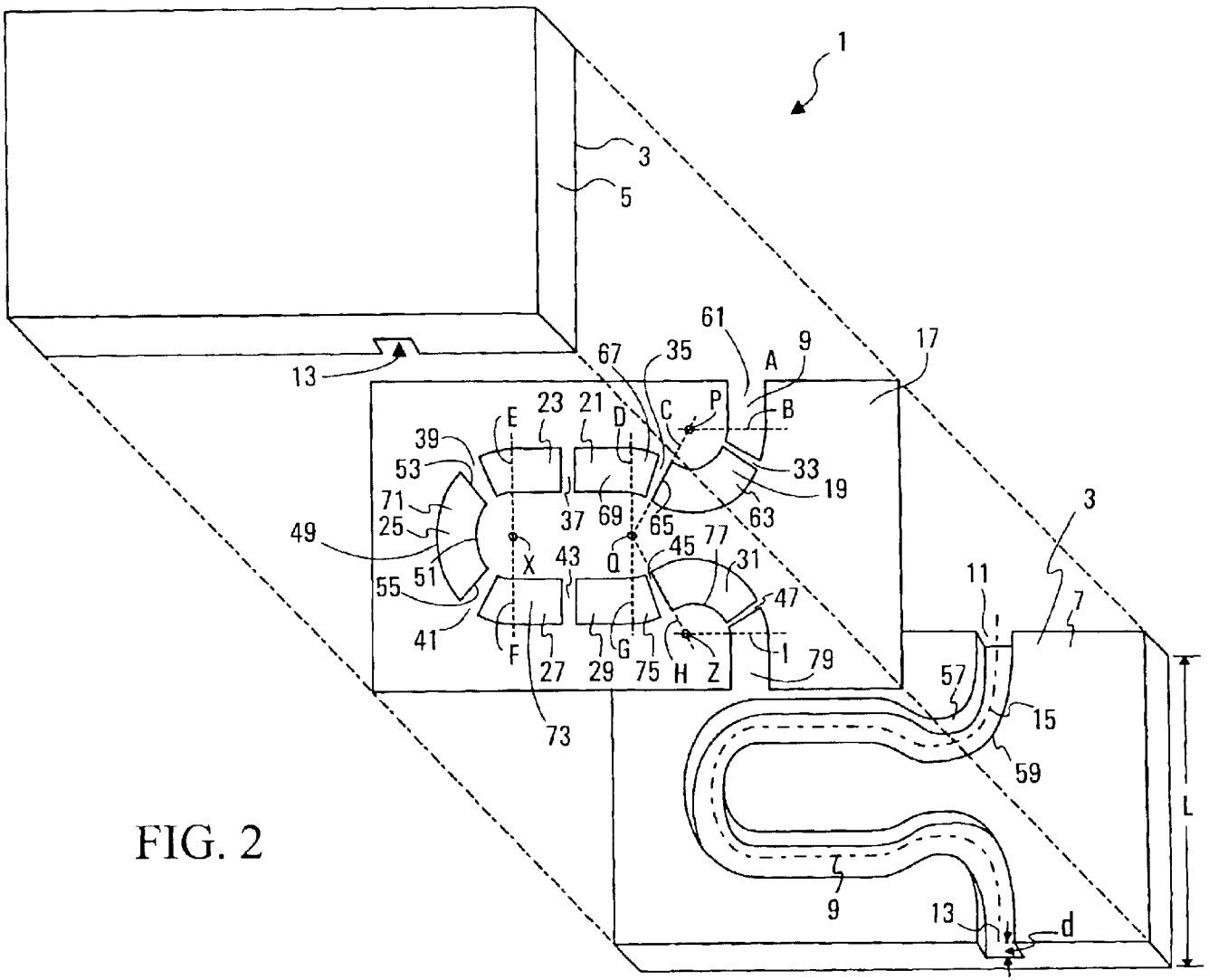
FIG. 2 shows an exploded view of an example of an E-plane filter according to an embodiment of the present invention.

Referring to FIG. 2, an E-plane filter according to an embodiment of the present invention, generally shown at 1, comprises a waveguide housing 3 having two sections 5, 7. A waveguide filter channel 9 having a first port 11 (which may serve as an input or output) and a second port 13 (which may serve as an input or output) is formed in each housing section 5, 7 and which traces a non-linear path between the first port 11 and the second port 13, as shown in the housing section 7, and which is the same in the housing section 5, although not shown. For the purpose of the description, the first port 11 will be referred to as an input and the second port 13 will be referred to as an output.

The E-plane filter also comprises a septum 17 which is positioned between the housing sections 5, 7 and defines a series of resonator openings 19, 21, 23, 25, 27, 29, 31 and coupling sections 33, 35, 37, 39, 41, 43, 45, 47 which follow the same, non-linear path 15 as the channels 9 formed in the housing sections 5, 7. Each resonator opening 19 to 31 is defined by two opposed side edges 49, 51 and the opposed end edges 53, 55 of two adjacent coupling sections. In this embodiment, the side edges 49, 51 of each resonator corresponds to the contour of the first and second walls 57, 59 of the waveguide channels 9. However, in other embodiments, the side edges of the resonator need not follow the contour of the channel walls, and may, for example, lie outside the channel walls, thereby saving material.

The housing sections 5, 7 comprise an electrically conductive material such as metal at least at the surface of the channels. The septum 17 also comprises an electrically conductive material, at least at the surface of the coupling sections. For example, the septum may comprise a thin metal foil or sheet.

In this particular embodiment, the septum 17 is formed to provide seven series resonators and eight coupling sections, although other embodiments may have more or fewer resonators and coupling sections.

As can be seen most clearly from the plan view of the septum 17 shown in FIG. 2, the waveguide channel 9 in which the resonators and coupling sections are accommodated comprises a number of curved and linear sections, which will now be described in more detail.

Referring again to FIG. 2, the channel 9 includes a first linear section 61 at the input 11 between points A and B and an adjacent curved section 63 between radii of curvature B and C and centered at "P" which lies outside the channel 9. The curved section 63, which in this embodiment turns through more than 90°, accommodates the first coupling section 33 and the first resonator 19. The end of the curved section 63 is defined by the radius C, centered at 'Q', which coincides with the leading end 65 of the next coupling section 35.

From the radius C, the channel 9 turns in the opposite sense to the curved section 63, about an angle of less than 90° to radius D. This second curved section 67 accommodates the second coupling section 35 and part of the second resonator 21. From the radius of curvature D, the channel 9 includes a linear section 69 which extends between the radius D and the radius E, the latter being centered at 'X'. This second linear section 69 accommodates part of the second resonator 21, the third coupling section 37 and part of the third resonator 23. From the radius E, the channel turns through 180° to the radius F. This third curved section 71 of the waveguide filter channel 9 accommodates part of the third resonator 23, the fourth coupling section 39, the fourth resonator 25, the fifth coupling section 41 and part of the fifth resonator 27.

From the radius F, the channel continues along a linear path between the radius F and the radius G, the latter being centered at Q. This linear section 73, which extends between the radii F and G, accommodates part of the fifth resonator 27, the sixth coupling section 43 and part of the sixth resonator 29.

From the radius G, the waveguide channel 9 turns inwardly through an angle of less than 90° to the radius H. This curved section 75 of the waveguide channel 9, which extends between the radii G and H accommodates part of the sixth resonator 29 and the seventh coupling section 45.

From the radius H, which is centered at 'Z', the waveguide channel 9 turns in the opposite sense through an angle of more than 90° to the radius I. This curved section 77, which extends between the radii H and I accommodates the seventh resonator 31, the eighth coupling section 47 and part of the output 13 of the waveguide channel. Lastly, from the radius I, the waveguide filter channel includes a linear section 79 at the waveguide output 13.

In this example, the path of the waveguide filter channel is shaped such that the distance between the input 11 and the output 13 is shorter than the channel length, so that, advantageously, the waveguide housing can have dimensions which are considerably less than the dimensions required for an E-plane filter having a linear-waveguide channel. In this particular embodiment, the distance between the input and the output is about one third of the length of the channel and is accomplished by arranging the channel to curve away and then back toward itself so that the channel path is shaped as a loop or 'Ω'.

The example shown in FIG. 2 illustrates an embodiment in which a coupling section may be accommodated within a curved section of channel and a resonator may be accommodated entirely within a curved section of channel or a section of channel which is part linear and part curved. In other embodiments, the coupling section may be accommodated within a section of channel which is also part curved and part linear.

In other embodiments, the resonator and/or coupler may be accommodated within a channel where the radius of curvature is not constant and which may or may not also be part linear. As we shall see below, the precise characteristics of an E-plane filter may be easily determined whether any resonator or coupler is accommodated within a curved channel, either having a constant or varying radius of curvature or a part linear, part curved channel. The inventor has found that the length of the center line, centered along the channel between the ends of a resonator or coupling section can precisely relate the characteristics of a non-linear channel E-plane filter to a linear-channel E-plane filter, under certain conditions. In particular, the frequency characteristics of a curved resonator are substantially identical to a linear resonator whose length is equal to the length of the centre line along the curved resonator if the radius of curvature of the centre line is about twice the operating frequency wavelength or more. This relationship may also hold true for a smaller radius of curvature, but corrections may have to be applied as the radius decreases below a certain value. This dimensional relationship between curved and linear resonators has been found to be valid for a series of resonators accommodated in a curved channel where the radius of curvature is constant. For resonators accommodated in part curved, part linear channels, or channels of non-constant radius of curvature, this relationship may hold true for gentle curves, and/or depending on where the resonators are located with respect to the linear and curved portions of the channel. This allows the desired shape of channel path to be chosen without the need to consider the position of the resonators and coupling sections along the length of the channel. The dimensions of the resonators and coupling sections for the non-linear channel to give the required frequency characteristics can then be precisely determined based on the dimensions of the resonators and coupling sections for a linear waveguide, irrespective of whether the shape of the channel path in which a coupling section or resonator is situated is curved or part curved, part linear, with a radius of curvature which is either constant or varying. However, as the radius of curvature decreases, the relationship between the dimensions of the linear and curved resonators become less exact, particularly for part curved, part linear resonators or resonators whose radius of curvature varies along their length.

Next, the manner in which the desired characteristics of an E-plane filter are implemented in a non-linear channel E-plane filter will be described with reference to FIGS. 3 to 6 which illustrate examples of various waveguide channels or channel sections.

Figure 3:
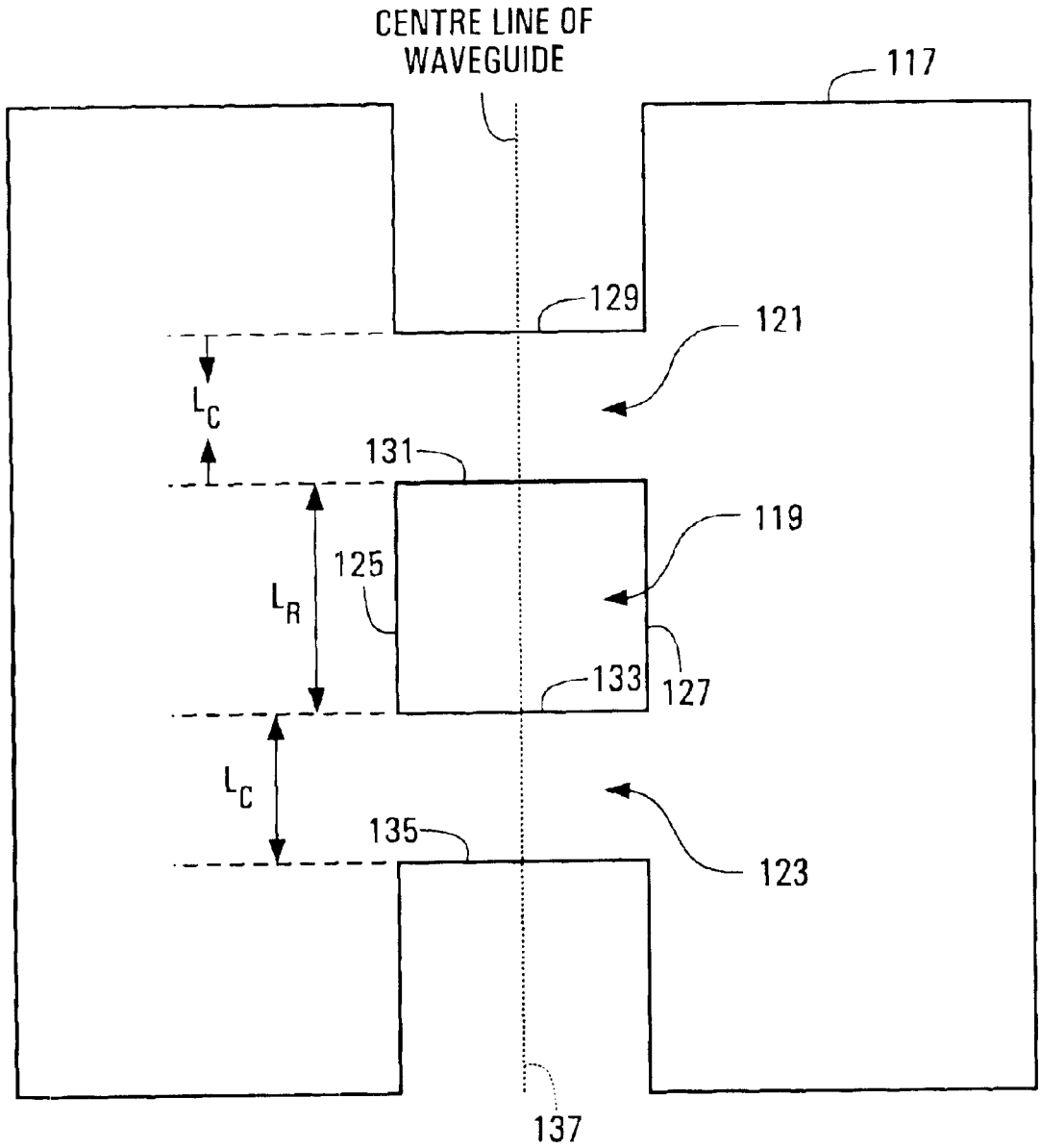
FIG. 3 shows a plan view of a linear septum for an E-plane filter.

FIG. 3 shows a plan view of a septum 117 defining a linear resonator 119 and two coupling sections 121, 123. The side edges 125, 127 of the resonator 119 are straight and parallel and are separated by a distance corresponding to the width between the walls of a linear waveguide channel. The end edges 129, 131, 133, 135 of the first and second coupling sections 121, 123 are also linear and parallel to each other and intersect the linear center line 137, drawn through the couplers 121, 123 and resonator 119, at right angles. The length $L_R$ of the resonator 119, corresponds to the length of the center line 137 between the opposed ends 131, 133 of the first and second coupling sections 129, 123. The length, $L_C$, of a coupling section corresponds to the length of the center line 137 between its respective end edges 129, 131 or 133, 135.

The frequency characteristics of a linear E-plane filter are generally determined by the length $L_R$ Of the resonator and the depth "d" of the waveguide channel (shown in FIG. 2). For a band-pass filter, the length of the resonator $L_R$ is about half the wavelength of the pass-band center frequency. The length $L_C$ of the coupling sections is also determined from the desired band pass center frequency, and the desired bandwidth. The length of the resonator and coupling sections in a straight waveguide filter required for particular frequency characteristics may be determined using commercially available software, such as WASP-NET lite 5.0, Eseptum or EpFil, or may be determined analytically using mode theory and mode matching techniques described in electromagnetic engineering text books such as: Analytical Filter Design Theory; Matthei, Young and Jones; "Microwave Filters, Impedance-Matching Networks and Coupling Structures", Artech House Books, 1980; C. A. Balanis, "Advanced Engineering Electromagnetics", John Wiley & Sons, 1989, or R. E. Collin, "Foundations for Microwave Engineering", $2^{nd}$ Ed. McGraw-Hill Inc, 1992.

Figure 4:
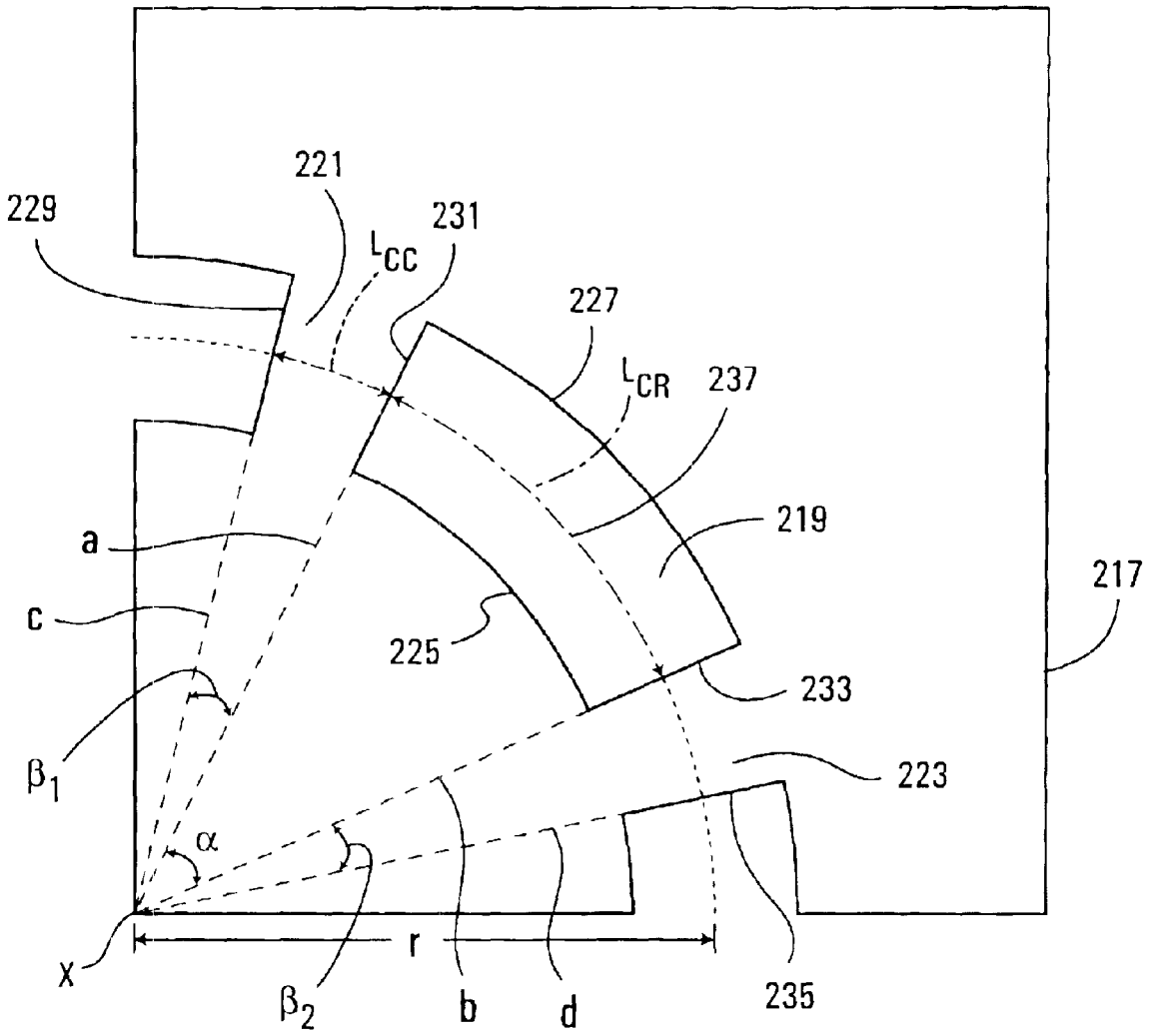
FIG. 4 shows a plan view of a septum according to an embodiment of the present invention.

FIG. 4 shows an example of a septum which defines a resonator and two coupling sections which are to be accommodated in a curved channel or channel section of an E-plane filter. The septum 217, which may comprise an electrically conductive sheet, such as a metal foil, has a resonator opening 219 formed therein and first and second coupling sections 221, 223. The resonator 219 has curved inner and outer side edges 225, 227 which are parallel and have a common center of curvature at "X". The end edges 231, 233 of the resonator, which correspond to the opposed end edges of the first and second coupling sections 221, 223, are both linear and lie on a respective radius a, b drawn from the center of curvature X. The other end edges 229, 235 of the first and second coupling sections 221, 223 are also linear and lie on a respective radius c and d drawn from the common center of curvature X.

The septum shown in FIG. 4 is designed to be accommodated within a curved waveguide channel in which the section of the channel that accommodates the first and second coupling sections 221, 223 and the resonator 219 has a curved center line 237 centered between the channel walls whose center of curvature coincides with the common radius of curvature X.

To determine the separation between the ends 231, 233 of the curved resonator in order to give the desired frequency characteristics, the required length $L_R$ to give those characteristics, is first calculated for a linear channel having the same cross-sectional geometry. The lengths of the linear resonator may be calculated using commercially available software or by mode theory and mode matching techniques, as described above. The correct separation between the ends of the curved resonator to yield the required frequency characteristics is such that the length $L_{CR}$ of the center line 237 between the ends 231, 233 of the curved resonator is equal to the length $L_R$ of the linear resonator, and may be expressed as:

$$L_{CR}=L_R=\alpha\times r$$

where $\alpha$ is the angular separation (in radians) between the radii a and b on which the ends of the resonator lie and r is the radius of curvature of the center line from the common center of curvature X.

Similarly, to determine the separation between the ends of each coupling section in a curved channel for the desired frequency characteristics, the length $L_C$ of a coupling section in a linear waveguide channel having the same cross-section is first determined for those frequency characteristics, for example using software modelling or mode theory and matching techniques described above. The correct separation between the ends of the coupling section corresponds to a length $L_{CC}$ of center line 237, centered between the walls of the channel, between the ends of the coupling section which is equal to $L_C$ calculated for the linear resonator, and may be expressed as:

$$L_{CC}=L_C=\beta\times r$$

where $\beta$ is the angular separation (in radians) between the radii a and c or b and d on which the ends of each coupling section lies and r is the radius of curvature of the center line 237 from the common center of curvature X.

Figure 5:
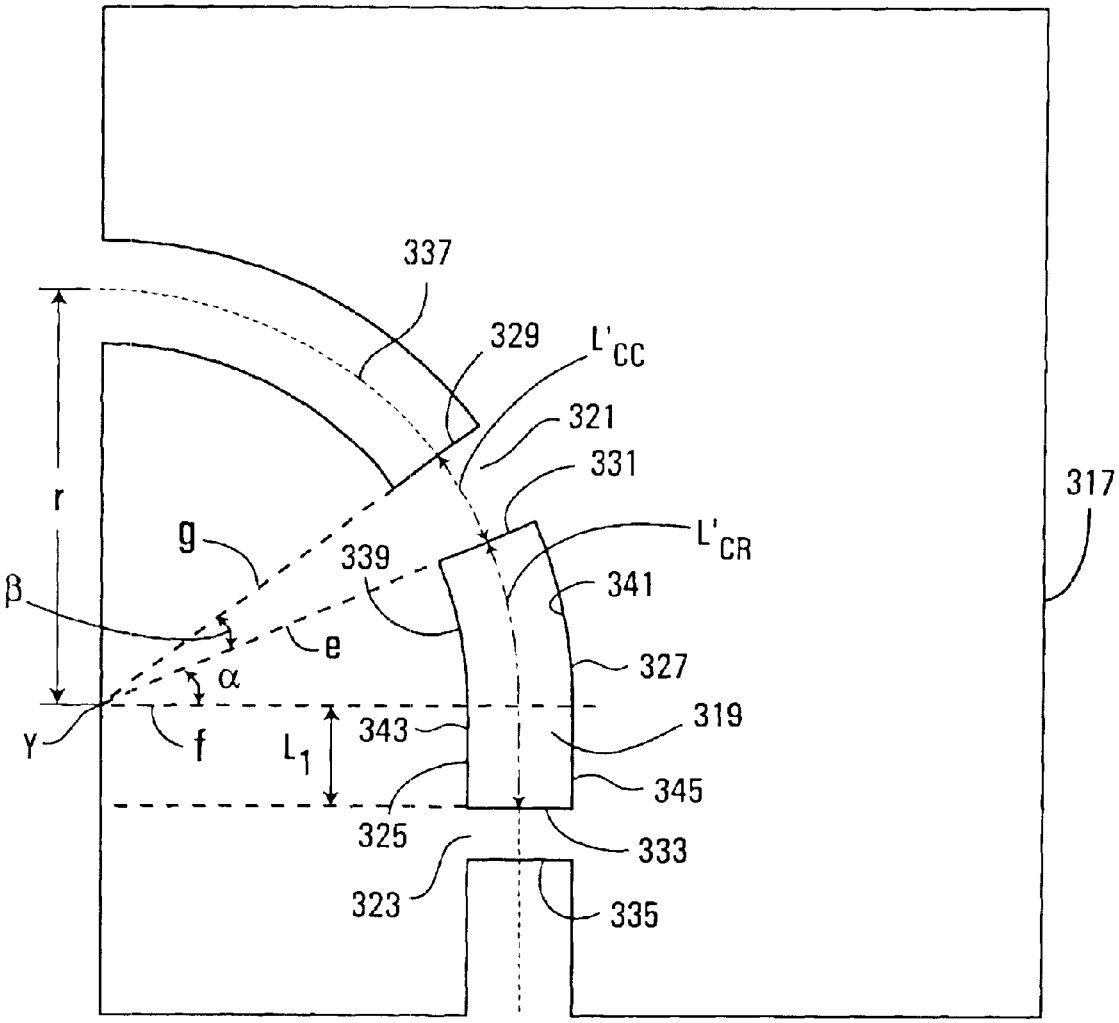
FIG. 5 shows a plan view of a septum according to another embodiment of the present invention.

FIG. 5 shows a plan view of an example of a septum 317 which includes a resonator 319 which is designed to be accommodated in a waveguide channel which is part curved and part linear. The side edges 325, 327 of the resonator 319 are parallel and correspond to the contour of the walls of the waveguide channel in which they are to be accommodated. The side edges include inner and outer curved sections 339, 341 having a common center of curvature Y and extending between the radii e and f, and linear sections 343, 345 extending between the radius f and the end edge 333 of the resonator 319. The septum includes a first coupling section 321 which is to be accommodated within the curved section of the waveguide channel and has end edges 329, 331 which are linear and lie on radii the g and e, respectively drawn from the common center of curvature Y. The septum further includes a second coupling section 323 having end edges 333, 335 which are both linear and which is to be accommodated in a linear section of the waveguide channel.

The septum 317 shown in FIG. 5 is to be accommodated in a waveguide channel or channel section whose center line, centered between the walls of the channel is shown by the dash line 337.

To determine the correct separation between the ends of the resonator 319 for the required frequency characteristics, the length of a resonator in a linear channel having the same cross-section required to give those frequency characteristics is first determined, for example, by conventional software modelling or mode matching techniques. The correct separation between the ends of a part curved, part linear resonator is such that the sum of the lengths of the center line through the curved and linear parts of the resonator is equal to $L_R$, calculated for the linear resonator. The length of the center line $L'_{CR}$ which determines the correct separation between the ends of a part curved, part linear resonator may be expressed as:

$$L'_{CR}=L_R=\alpha\times r+L_1$$

where $\alpha$ is the angular separation (in radians) between the radii e and f which define the extent of the curved section in which the resonator is accommodated, r is the radius of the center line from the common center of curvature Y, and $L_1$ is the length of the linear section of the resonator.

To determine the correct separation between the ends of the first coupler 321 to provide the required frequency characteristics, the procedure described above in connection with FIG. 4 is followed. Thus, the required length $L_C$ of coupling section required to give the desired frequency characteristics for a linear waveguide channel is first calculated and the correct separation, for the curved coupling section 321 is such that the length $L'_{CC}$ of the center line 337 between the ends of the coupling section is equal to $L_C$ determined for the linear coupling section, and is given by:

$$L'_{CC}=L_C=\beta\times r$$

where $\beta$ is the angular separation (in radians) between radii e and g.

The correct length of the linear coupling section 323 to provide the desired frequency characteristics is calculated on the basis that the coupling section is accommodated in a linear waveguide channel and corresponds to that length so calculated.

In other embodiments, a resonator or coupling section may be accommodated in a waveguide channel which, over the length of the resonator and/or coupling section includes more than one curved section and/or more than one linear section. In this case, the correct separation between the ends of the resonator and/or coupling section is such that the sum of the lengths of the center line through each curved and linear section in which the resonator or coupler is accommodated is equal to the length of a linear resonator or coupler in a linear waveguide channel having the same cross-section, required for the same frequency characteristics.

Figure 6:
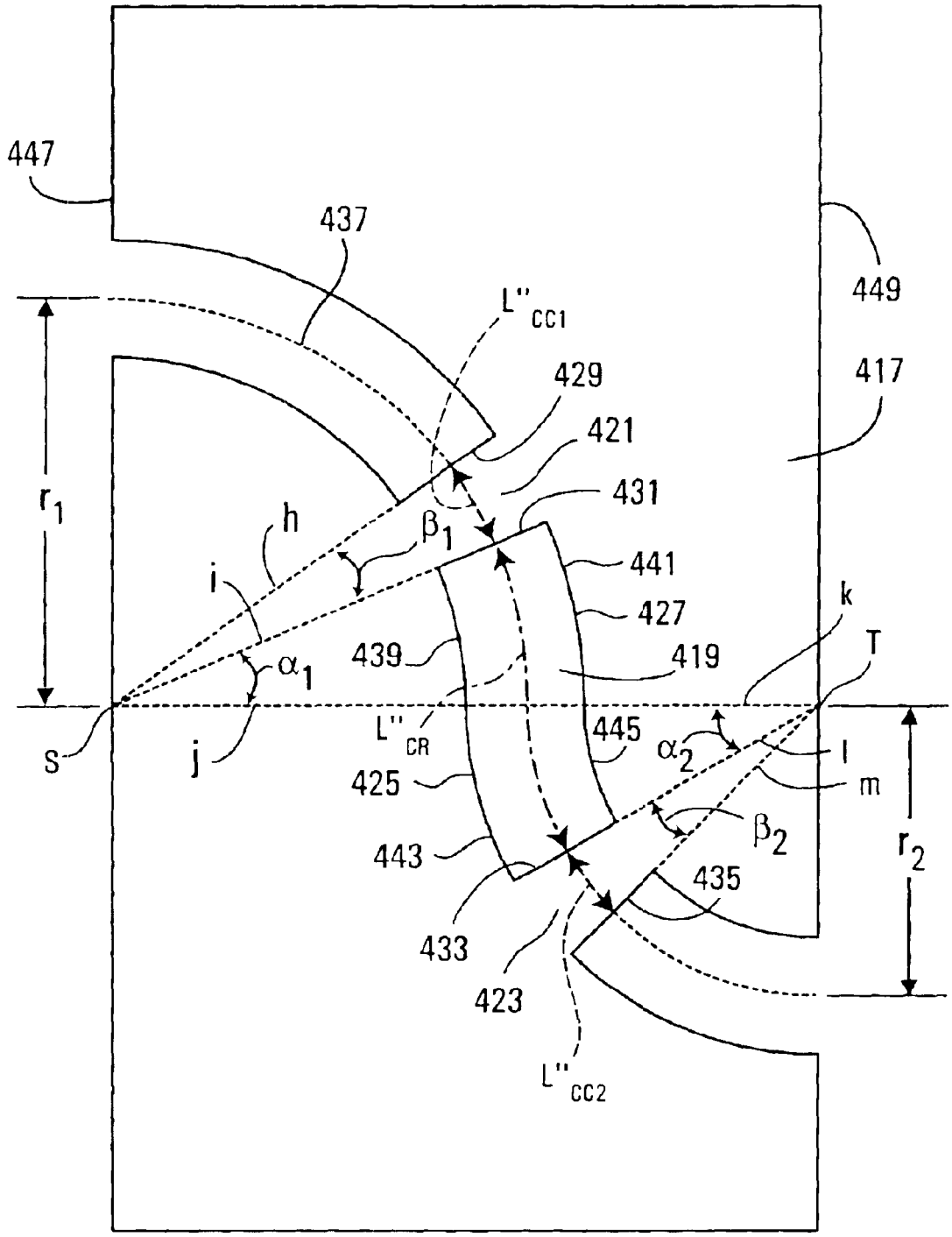
FIG. 6 shows a plan view of a septum according to another embodiment of the present invention.

FIG. 6 shows an embodiment of a septum having a resonator which is designed to be accommodated within a curved section of channel whose radius of curvature changes within the length of the resonator.

Referring to FIG. 6, a septum 417 includes a resonator 419 having opposed side edges 425, 427 which are parallel to each other and correspond to the contour of the walls of the waveguide channel in which the resonator is to be accommodated. The side edges include a first curved section 439, 441 having a common center of curvature S and extending between the radii i and j, and a second curved section 443, 445 which turns in the opposite sense to the first curved section, and which has a common center of curvature T, and extends between the radius k, which coincides with the radius j, and the radius l.

The septum 417 has a first coupling section 421 which is to be accommodated within the first curved section of waveguide channel whose radius of curvature is centered at S, and has end edges 429, 431 which are linear and lie on the radii h and i, respectively.

The septum includes a second coupling section 423 which is to be accommodated within the second curved section of waveguide channel whose curvature is centered at T, and has end edges 433, 435 which are linear and lie on the radii l and m, respectively.

The center line which is centered between the walls of the waveguide channel in which the septum is to be accommodated is shown by the dashed line 437. In this example, the center line 437 follows a curve, having a radius $r_1$ centered at S, from the left hand side 447 of the septum to the radius j, at which point the center line 437 follows a second curve having a radius $r_2$, which turns in the opposite sense and extends from the radius j or k to the right hand side 449 of the septum 417.

To determine the correct separation between the ends of the resonator 419 for the required frequency characteristics, the length $L_R$ of a resonator in a linear channel having the same cross-section required to give those frequency characteristics is first determined, for example, by conventional software modelling or mode matching techniques. The correct separation between the ends of the curved resonator 419 which is to be accommodated in a curved waveguide channel comprising two adjacent curved sections with different radii of curvature is such that the sum of the lengths of the center line through each curved section in which the resonator is accommodated is equal to the length $L_R$ between the ends of the linear resonator calculated for a linear waveguide channel of the same cross-section. The length of the center line $L''_{CR}$ which determines the correct separation between the ends of the curved resonator 419 may be expressed as:

$$L''_{CR}=L_R=\alpha_1\times r_1+\alpha_2\times r_2$$

where $\alpha_1$ is the angular separation (in radians) between the radii i and j which define the extent of the first curved section, centered at S, in which the resonator 419 is accommodated, $r_1$ is the radius of curvature of the center line 437 of the first curved section from the common center of curvature S, $\alpha_2$ is the angular separation (in radians) between the radii k and l which define the extent of the second curved section, centered at T, in which the resonator is accommodated, and $r_2$ is the radius of curvature of the center line of the second curved section from the common center of curvature T.

To determine the correct separation between the ends of the first and second coupling sections 421, 423 to provide the required frequency characteristics, the procedure described above in connection with FIG. 4 is followed. Thus, the length $L_C$ of coupling section required to give the desired frequency characteristics for a linear waveguide channel of the same cross-section of the curved waveguide channel is first calculated, for example using conventional techniques described above. The correct separation between the ends for the curved coupling sections 421, 423 is such that the length of the center line 437 between the ends of the respective coupling section is equal to $L_C$ determined for the linear coupling section.

For the first coupling section 421, the length of the center line between the ends 429, 431 is given by the expression:

$$L''_{CC1}=L_C=\beta_1\times r_1$$

where $\beta_1$ is the angular separation (in radians) between radii h and i which define the extent of the first curved section of the waveguide channel in which the coupling section 41 is accommodated and $r_1$ is the radius of curvature of the center line through the first section of waveguide channel from the common center of curvature S.

For the second coupling section 423, the length of the center line between the ends 433, 435 of the second coupling section is given by the expression:

$$L''_{CC2}=L_C=\beta_2\times r_2$$

where $\beta_2$ is the angular separation (in radians) between radii l and m which define the extent of the second curved section of the waveguide channel in which the second coupling is accommodated, and $r_2$ is the radius of curvature of the center line 437 in the second section of waveguide channel centered at the common center of curvature T.

The principles described above in connection with the embodiment of FIG. 6 which realize a curved resonator in a curved waveguide channel having two different radii of curvature may be extended to realize a curved resonator in a curved waveguide channel whose radius of curvature changes twice or more within the length of the resonator. To determine the correct length of such a resonator for the required frequency characteristics, the length $L_R$ of a linear resonator for the same waveguide channel cross-section is first calculated. The correct length of the curved resonator is such that the sum of the lengths of the center line in each curved section in which the resonator is accommodated is equal to the length $L_R$ calculated for the linear resonator. In general, the length of the center line of a curved resonator is given by the expression:

$$L_{CR}=\sum_{1}^{n}\alpha_n x r_n$$

where n is the number of curved sections in which the resonator is accommodated, $\alpha_n$ is the angle between the radii of curvature of the nth curved section in which the resonator is accommodated and $r_n$ is the radius of curvature of the center line of the nth curved section.

One or more coupling sections may also be accommodated within a curved waveguide channel in which the radius of curvature changes once or more within the length of the coupling section. The correct separation between the ends of such a coupling section for the desired frequency characteristics is determined by first calculating the length of coupling section required for those frequency characteristics in a linear waveguide channel having the same cross-section. The correct separation between the ends of the curved coupling section is such that the sum of the lengths of the center line through each curved section in which the coupling section is accommodated is equal to the length of the coupling section calculated for the linear waveguide/channel.

It has been found that the separation between the ends of a resonator or coupling section based on the relationship between the length of the center line of the non-linear resonator or coupler and the length of the resonator or coupler accommodated in a linear waveguide channel can be precisely calculated, without correction, under the conditions described below, where the end edges of the resonator/coupling section are linear and intersect the center line at right angles thereto and, if the resonator or coupling section is accommodated in a waveguide section which has a transition region where the radius of curvature changes or a curved section meets a linear section, the center line of each section is tangential to the center line of the adjacent section.

If one or more ends of a resonator or coupling section are non-linear and intersect the center line at an angle other than at right angles and the center lines of adjacent sections are not tangential, a correction in the separation between the ends of a resonator or coupling section to provide the required frequency characteristics may be necessary, depending on the degree of excursion.

Furthermore, under the conditions described below no correction may be required to the length of the center line through a curved section of waveguide channel if the channel walls through the curved section are parallel and the radii of curvature of both walls are finite and have a common centre which lies outside the curved section of channel.

It is to be noted that the relationships described above equating the centre line dimension of the filter components (e.g. resonator and coupler), with the physical length of respective components of a linear waveguide for given performance characteristics is substantially valid under certain conditions, but not others. In particular, this method of calculating the dimensions of a non-linear resonator to provide required frequency characteristics is substantially valid if the radius of curvature of the resonator is sufficiently large. As mentioned above, for a resonator whose centre line radius of curvature is $2\times\lambda_0$ (where $\lambda_0$ is the free space wavelength of the centre frequency), or more, the performance of the curved resonator is substantially the same as a linear resonator, where the length of the curved centre line of the curved resonator is equal to the length of the linear resonator. However, as the radius of curvature of the centre line decreases, and the curve becomes tighter, the more the performance of the resonator will depart from that of its linear counterparts. Also, waveguide filters in which the channel includes a combination of curved and straight sections have been found not to perform as closely to their linear counterparts as waveguide filters in which the channel comprises curved sections only, and this increased excursion of curvi-linear waveguides over curved waveguides becomes more apparent as the radius of curvature of the curved sections decreases. It has also been found that the performance of an E-plane filter having both straight and curved sections, for example in which the radius of curvature is about the same as the centre frequency wavelength ($\lambda_0$), will vary depending on the centre frequency and the placement of the resonator sections with respect to straight and curved portions of the channel.

Therefore, it may be preferable in designing a non-linear E-plane waveguide to provide the waveguide channel with a sufficient radius of curvature to take advantage of the simple relationship between the dimensions of the non-linear components and their linear counterparts, for ease in calculating the required dimensions of the non-linear components to yield the desired performance characteristics. Where the waveguide channel is designed to operate with a range of centre frequencies, the minimum radius of curvature should be determined based on the lowest centre frequency (i.e. the longest wavelength) of the required operating range, so that the simple relationship will then apply over the whole frequency range.

However, while it may be convenient to design a non-linear E-plane waveguide in which the simple relationship between the dimensions of non-linear and linear components applies, the required dimensions of a non-linear filter to give a particular performance, which is so designed that the simple relationship no longer applies can still be determined, for example using computer modelling techniques. One method may include specifying a desired performance to a computer which models linear filters to provide the required dimensions of the filter components for the specified performance. These dimensions are then adjusted based on the shape of the waveguide channel and the adjusted dimensions are then provided to a further computer model which simulates the performance of a filter based on the adjusted dimensions. The performance calculated by the simulator is then compared to the performance calculated by the optimizer and the dimensions adjusted further if necessary. This process may be repeated a number of times until the correct dimensions of the components for the non-linear filter have been determined to provide the required performance. A suitable program for simulating the performance of a waveguide structure is a three-dimensional electromagnetic simulator, for example the high frequency structure simulator (HFSS) by Ansoft Corporation.

It is to be noted that where a resonator is accommodated in a curved waveguide channel whose radius of curvature changes one or more times over the length of the resonator or coupling section, each section of curve may turn in the same sense or different sections may turn in opposite senses as for example, shown in FIG. 6.

Figure 7A:
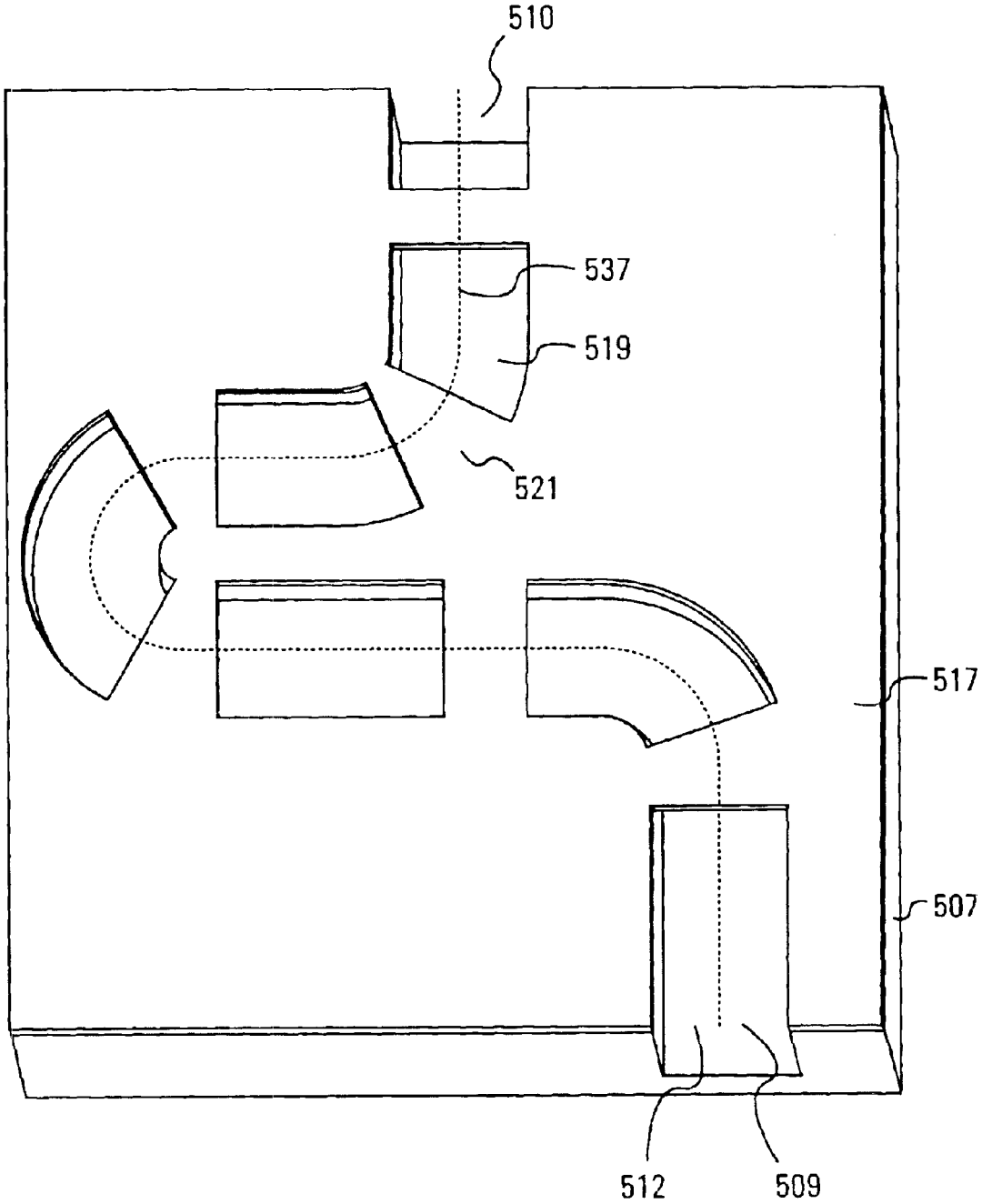
FIGS. 7*a* and 7*b* each show a perspective view of a septum and waveguide housing section according to another embodiment of the present invention.
Figure 7B:
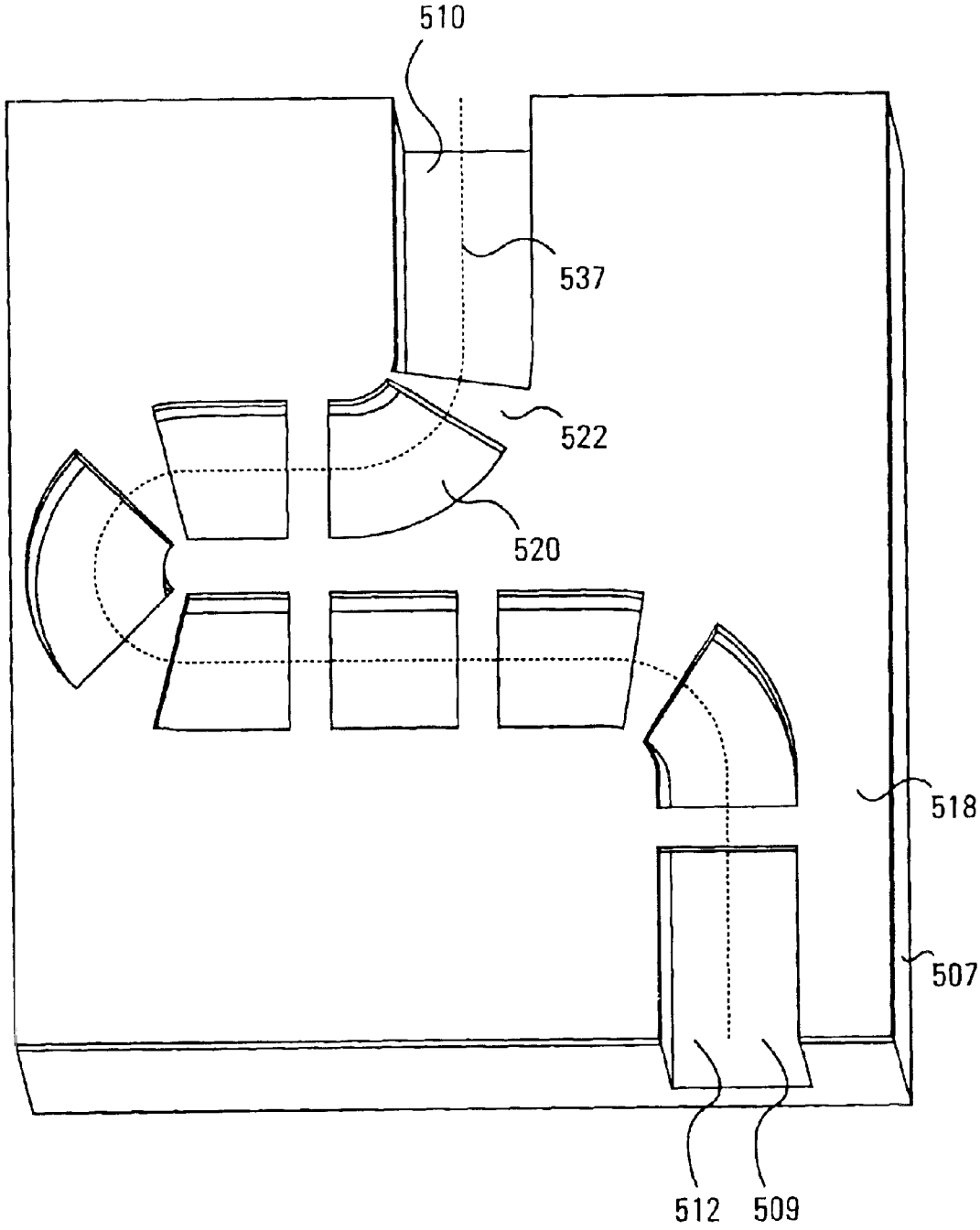

The design principles described above can be used to produce waveguide filters having different frequency characteristics but which employ a housing having a single design of waveguide channel path. An example of this aspect of the present invention is illustrated in FIG. 7A and 7B. These Figures both show part of a waveguide filter including a housing section 507 and a septum 517, 518 positioned adjacent and registered with a respective housing section 507. Each housing section 507 has a waveguide channel 509 formed therein and both waveguide channels 509 are identical. The waveguide channels 509 trace a non-linear path which includes both linear and curved sections as indicated by the dashed center line 537. Each septum 517, 518 includes a series of resonators 519, 520 and coupling sections 521, 522 arranged along the respective non-linear waveguide channel 509.

In this embodiment, the input part 510 of the waveguide channel 509 is offset across the width of the waveguide housing; 507 relative to the output part 512, as may be required for integration of the filter with other system components.

The dimensions of the waveguide channel 509 are chosen to allow the waveguide to operate over a predetermined frequency range. In the case of a pass band filter, the pass band centre frequency for each filter is determined by the dimensions of the resonators and coupling sections and in particular by the length of the centre line 537 between the ends of each resonator and coupling section. The septum 517 of the waveguide filter shown in FIG. 7*a* is designed to provide particular frequency characteristics which are different from those provided by the septum 518 of the waveguide filter shown in FIG. 7*b* as is apparent from the difference between the lengths of the centre line 537 through the resonators 519, 520 of each septum and the difference in the lengths of the centre line 537 through the coupling sections 521, 522 of each septum.

To calculate the dimensions for the resonator openings and coupling sections of each septum required to provide the desired frequency characteristics, the required lengths of the resonator openings and coupling sections may first be calculated to provide those frequency characteristics in a linear waveguide having the same channel cross-section as the non-linear waveguide channel 509. The correct separation between the ends of each resonator opening in the septum for the non-linear channel, assuming that no correction is necessary (e.g. due to tight radius of curvature), is such that the length of the centre line 537 between the ends of the resonator is substantially equal to the length of the resonator calculated for the linear waveguide. Similarly, the correct separation between the ends of each coupling section is such that the length of the centre line 537 between the ends of each coupling section is substantially equal to the length of the corresponding coupling section calculated for the linear waveguide, assuming this simple relationship can be applied.

Using this method, it will be appreciated that a large number of waveguides having different frequency characteristics can be manufactured using waveguide housings having identical non-linear waveguide channels. One method of forming the non-linear waveguide channel in each housing is to use a casting process. Advantageously, a casting process can be used to produce large quantities of waveguide housings with very high dimensional accuracy from a single cast. The ability to readily implement waveguide filters of widely differing frequency characteristics using the same design of non-linear waveguide channel substantially increases the number of different characteristic waveguide filters that can be produced using a single cast, making it possible to produce compact, high precision waveguide filters at low cost which has not been possible before due to the expense of the casting process.

Figure 7C:
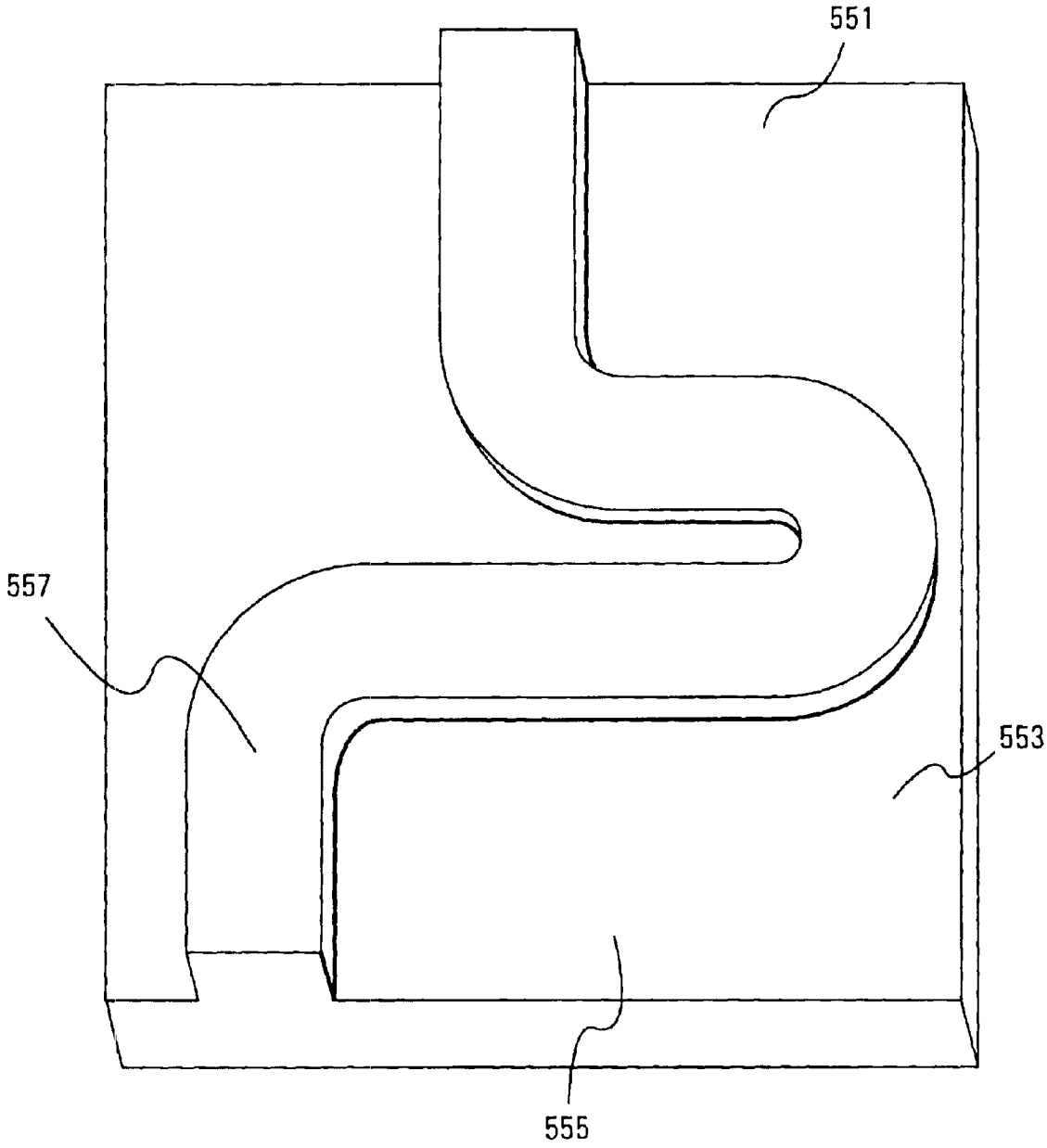
FIG. 7*c* shows a perspective view of a cast for casting a housing section, according to an embodiment of an aspect of the present invention.

An example of a cast for casting an E-plane filter housing section in accordance with an embodiment of another aspect of the present invention is shown in FIG. 7*c*. Referring to FIG. 7*c*, the cast 551 includes a body 553 having a planar surface 555 for forming an inner surface of the waveguide housing against which the septum is clamped. The cast further includes a non-linear elongate formation 557 extending from the surface and which is to form and define the waveguide channel in the housing section. In this embodiment, the elongate formation 557 corresponds to the shape of the waveguide channel 509 shown in FIGS. 7*a* and 7*b* although in other embodiments, the elongate formation may have any other suitable shape.

Figure 8:
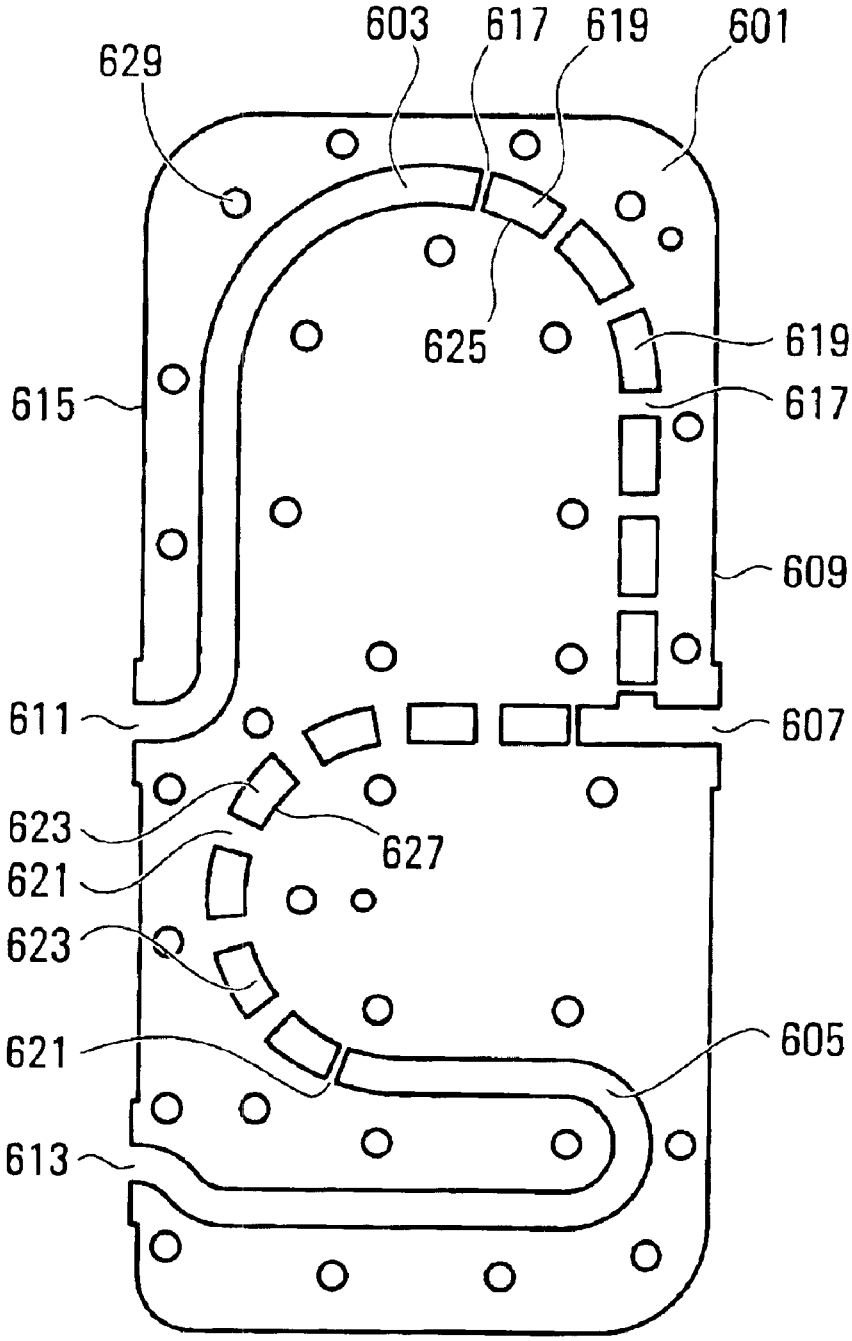
FIG. 8 shows a plan view of a septum according to another embodiment of the present invention.

FIG. 8 shows a plan view of a septum according to another embodiment of the present invention for use in an E-plane waveguide filter. The septum 601 which may be formed of thin metal sheet or foil, includes two channels 603, 605 which generally correspond to the shape of the waveguide filter channels of the waveguide filter housing in which the septum is to be accommodated. One end of the first and second channels share a first, common port 607 which is located on one side 609 of the septum 601, and the other end of each channel has a separate port 611, 613, respectively, which in this embodiment are located on the opposite side 615 of the septum 601. However, it is to be noted that in other embodiments, any of the first, second and third ports 607, 611, 613 may be located at any other suitable location along the edge of the septum. The septum 601 defines a plurality of couplers (or coupling sections) 617 spaced apart along the first channel 611, with adjacent coupling sections defining a resonator aperture 619 therebetween. Similarly, the septum defines a plurality of couplers or coupling sections 621 spaced apart along the length of the second channel 613, again with adjacent couplers 621 defining a resonator aperture 623 therebetween. In this embodiment, each of the first and second channels 611, 613 includes a curved section 625, 627 which accommodate a plurality of couplers 617, 621 and resonator apertures 619, 623.

As can be seen, the curved or serpentine configuration of the first and second channels allows the channels to be accommodated within a relatively small area, thereby allowing the septum to be relatively compact and considerably reducing the required dimensions in comparison to that which may be required to accommodate linear channels.

In use, the common port 607 may function as a bi-directional input/output port for receiving and transmitting RF signals, and may interface with a suitable antenna. One of the second and third port 611, 613 may serve as an input port for inputting RF signals from transmitter circuitry into the filter channel, and the other port may serve as an output port for outputting a received RF signal to receiver circuitry.

It is to be noted that the channel configuration of FIG. 8 allows the second and third ports 611, 613 to be located relatively close together, and in particular to be spaced at a distance which is less than the sum of the lengths of the first and second channels.

The septum 601 further includes a plurality of apertures or through holes 629 which allow screws or other fastening means to pass therethrough for securing two waveguide housing sections together that are placed either side of the septum.

Figure 9A:
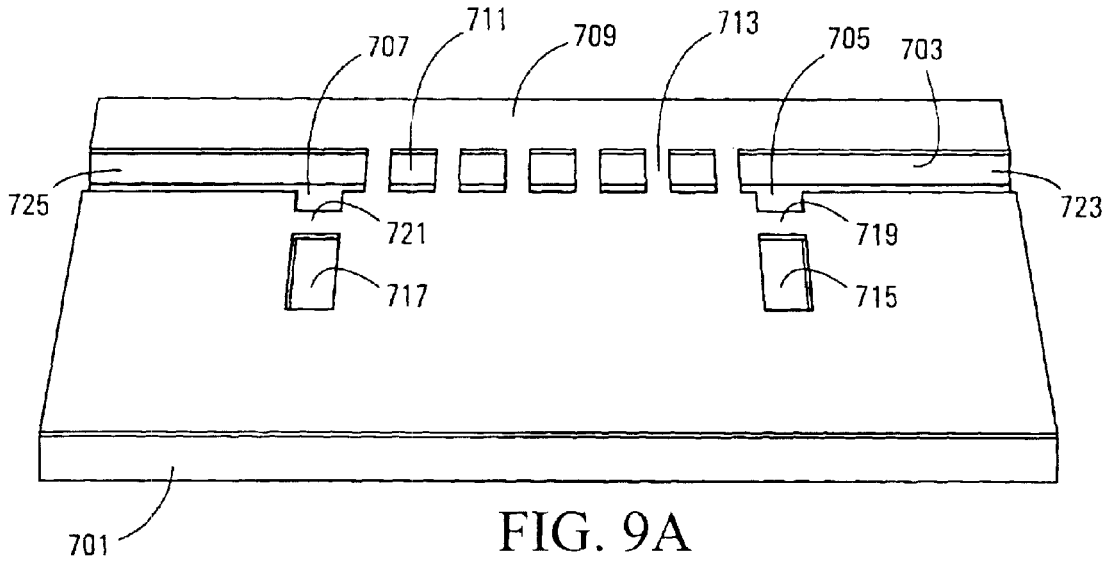
FIGS. 9A and 9B shows embodiments of a band stop filter.
Figure 9B:
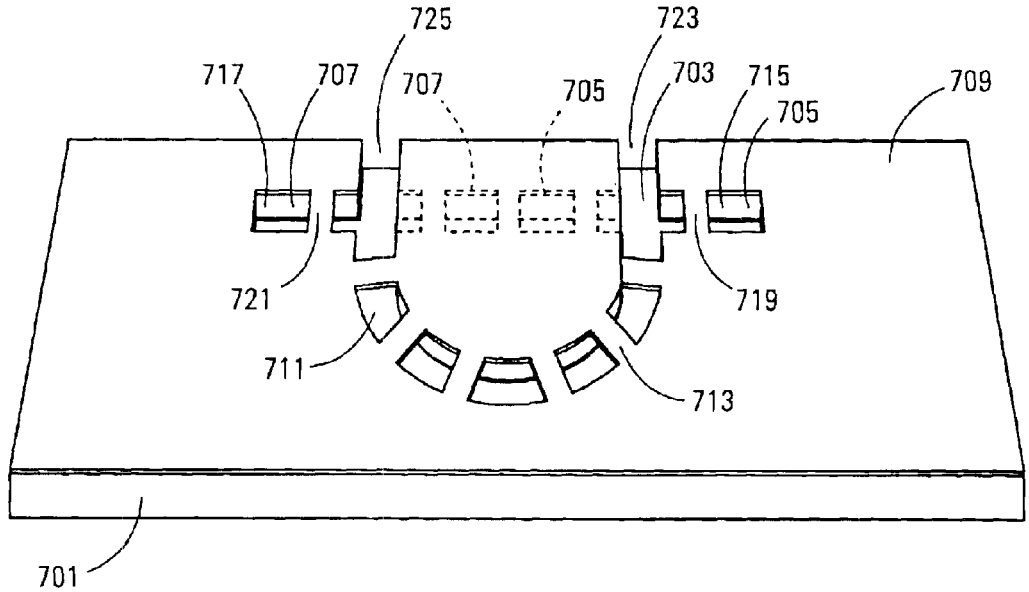

FIGS. 9A and 9B show examples of an E-plane waveguide channel housing section 701 incorporating an elliptic or band stop filter. As shown in FIG. 9A, the housing section 701 includes a linear waveguide 703 and two channel sections 705, 707 adjoining the linear waveguide channel 703 at spaced apart locations along the length of the waveguide channel, and substantially at right angles thereto. A septum 709 is placed adjacent the waveguide housing section 701 and includes a plurality of resonator openings 711 and coupling sections 713 arranged along the length of the linear waveguide channel 703. The septum further includes resonator openings 715, 717 and coupling sections 719, 721 accommodated in the waveguide sections 705, 707, respectively. Referring to FIG. 9B, in which like parts of the embodiment shown in FIG. 9A are designated by the same reference numerals, the main difference between this embodiment and that shown in FIG. 9A is that the waveguide channel 703 is curved, and in this particular embodiment turns through 180 degrees so that the input 723 and the output 725 of the waveguide channel 703 are located on the same side of the waveguide housing section 701. Advantageously, this arrangement allows the elliptic filter to be accommodated in a shorter length housing than required to accommodate a linear elliptic filter. In one arrangement, the short waveguide sections 705, 707 may each be located on the outer wall side of the waveguide channel, as shown by the continuous lines. However, in another arrangement one or each of the short waveguide sections 705, 707 may be located on the inside wall side of the waveguide channel 703, as shown by the dotted lines, to reduce the space required to accommodate the elliptic filter further.

Although in the embodiments shown in FIGS. 9A and 9B, the elliptic filter has two band stop waveguide sections, other embodiments may have one or any number of band stop waveguide sections.

Figure 10A:
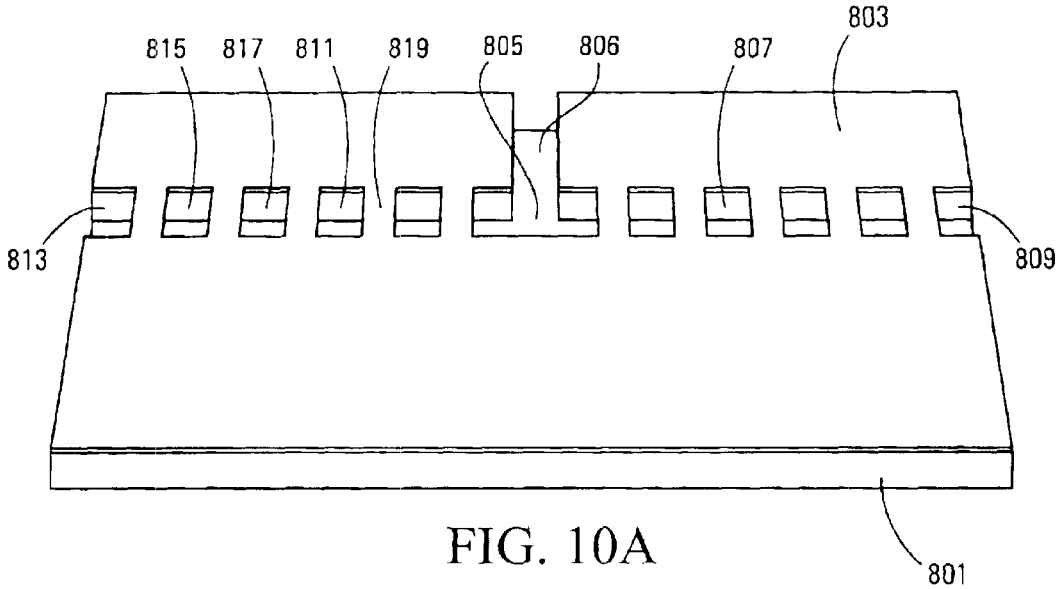
FIGS. 10A and 10B show embodiments of a diplexer.
Figure 10B:
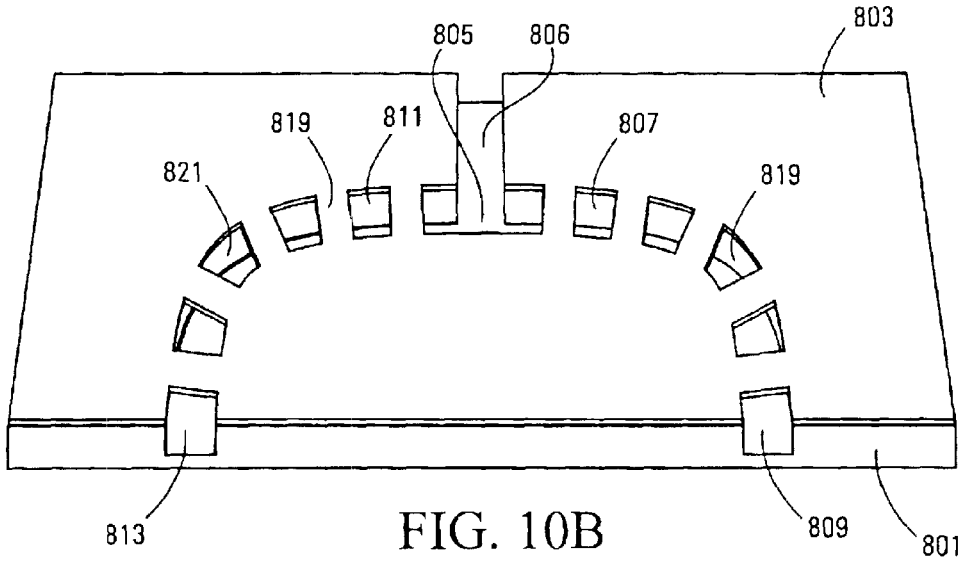

FIGS. 10A and 10B show embodiments of a waveguide housing section 801 and septum 803 which form a diplexer. The diplexer has a first common input/output port 805, formed at the intersection of the waveguide channel and "T" section 806, for receiving and transmitting electromagnetic signals to and from the waveguide. A first waveguide section 807 extends between the common port 805 and a second port 809 for passing electromagnetic signals within a first frequency band (in either direction), and a second waveguide section 811 extends between the common port 805 and a third port 813 for passing electromagnetic signals within a second predefined frequency band (in either direction), different from the first frequency band. The frequency band of each waveguide section 807, 811 are generally defined by the depth of the waveguide channel and the dimensions of the resonator and coupling sections 815, 817 of each section. The main difference between the embodiment shown in FIG. 10B and that shown in FIG. 10A is that both waveguide sections 807, 811 of FIG. 10B include a curved section 819, 821, which allows the diplexer to be accommodated in a waveguide housing having a dimension which is shorter than that required to accommodate the same but linear waveguide housing sections.

In other embodiments, one or both waveguide sections of a diplexer may be curved to any suitable extent, for example, to save space and/or to locate the waveguide channel input/output ports in the desired position.

In any of the embodiments described above as well as other embodiments, the side edges of the resonator openings need not conform to the contour of the walls of the waveguide channel and may be positioned away from the walls of the waveguide channel thereby saving material.

The septum may be formed by any suitable technique known to those skilled in the art, for example by any suitable etching technique.

In embodiments of the present invention, the E-plane filter and the septum may include a plurality of resonators spaced along the waveguide filter channel, and the filter channel may change direction within the portion of the channel which accommodates any one or more of the resonators, whether it is a portion of the channel which accommodates the first or last resonator or an intermediate resonator between the two.

According to an aspect of the present invention, there is provided an E-plane filter comprising a housing having a waveguide filter channel formed therein, a plurality of couplers extending between opposed first and second walls of the waveguide filter channel and spaced apart along the channel, adjacent couplers forming a resonator cavity therebetween, wherein the waveguide filter channel changes direction within a portion of the filter channel which accommodates the couplers and each resonator.

Any one or more features described above in connection with one embodiment may be incorporated into any other embodiment.

Embodiments of the E-plane filter having a non-linear channel may be implemented as a band-pass filter, a band-stop filter or any other waveguide filter.

In other embodiments, the E-plane filter housing may include more than one waveguide channel, where the second or subsequent waveguide channel is either entirely linear or includes one or more non-linear sections.

Modifications, additions and other changes to the embodiments described above will be apparent to those skilled in the art.

What is claimed is:

1. A septum for an E-plane filter, the septum defining a coupling element for extending across a waveguide channel of an E-plane filter, the coupling element having opposed ends which are angled relative to one another in the plane of the septum, whereby, in use, the coupling element is capable of being accommodated in an E-plane filter having a waveguide channel which changes direction within the length of said coupling element.

2. A septum as claimed in claim 1, wherein the ends of said coupling element are linear.

3. A septum as claimed in claim 2, wherein the ends of said coupling element are angled such that each end intersects the center line of a non-linear channel of an E-plane filter in which the septum is to be accommodated, at substantially right angles thereto.

4. A septum as claimed in claim 3, wherein said channel has a predetermined cross-section and the spacing between the opposed ends of said coupling element for passing a predetermined wavelength is determined such that the length of said center line between said ends is equal to the length of the center line between opposed ends of a corresponding coupling element of a septum for another E-plane filter for passing said predetermined wavelength, in which the channel accommodating the coupling element for said other E-plane filter is linear and has said predetermined cross-section.

5. A septum for an E-plane filter, the septum defining a first coupler and a second coupler each having an end defining a gap for a resonator cavity therebetween, wherein the ends are angled relative to one another in the plane of the septum to form the ends of a resonator cavity to be accommodated in a channel which changes direction within the length of said resonator cavity.

6. A septum as claimed in claim 5, wherein said ends are substantially linear.

7. A septum as claimed in claim 6, wherein the ends of said couplers are angled such that the center line of a non-linear-channel of an E-plane filter in which the resonator cavity between the opposed ends of the couplers is to be accommodated, intersects each of said ends substantially at right angles thereto.

8. A septum as claimed in claim 7, wherein said channel has predetermined cross-section and the spacing between the opposed ends of said couplers which define said resonator cavity for passing a predetermined wavelength is determined such that the length of said center line between said ends is substantially equal to the length of the center line between opposed ends of opposed couplers defining a resonator cavity in another E-plane filter for passing said predetermined wavelength, in which the channel accommodating the resonator cavity of said other E-plane filter is linear and has said predetermined cross-section.

9. An E-plane filter comprising a housing having first and second ports and a waveguide filter channel extending between said ports and for passing electromagnetic energy between said ports, first and second sheet coupling elements disposed within and directed along said waveguide filter channel, said coupling elements extending between opposed first and second walls of said waveguide filter channel and being spaced apart along said channel to form a resonator cavity therebetween, wherein said waveguide filter channel changes direction in a plane transverse to said first and second walls and within a portion of said filter channel which accommodates said first and second couplers and said resonator cavity.

10. An E-plane filter as claimed in claim 9, wherein said channel changes direction within a portion of said channel which accommodates at least one of said first and second coupling elements.

11. An E-plane filter as claimed in claim 10, wherein said change in direction of said channel is defined by each of said first and second walls being contained within at least two planes which intersect at an angle.

12. An E-plane filter as claimed in claim 10 wherein said channel changes direction within the portion of said channel which contains a middle port I on of said at least one coupling element.

13. An E-plane filter as claimed in claim 10, wherein said channel has a center line directed along said channel and centered between said first and second walls, and said at least one coupling element has opposed ends which are linear and intersect said center line substantially at right angles thereto.

14. An E-plane filter as claimed in claim 13, wherein said change in direction of said channel is defined by a curve in said first and second walls.

15. An E-plane filter as claimed in claim 14, wherein the center curvature of the curve in each of said first and second walls is positioned external of said channel.

16. An E-plane filter as claimed in claim 15, wherein said channel has a predetermined cross-section and a centre line along said channel and centered between said first and second walls and the spacing between the opposed ends of said at least one coupling element for passing a predetermined wavelength is determined such that the length of said center line between said ends is substantially equal to the length of the center line between opposed ends of a corresponding coupling element in an E-plane filter for passing said predetermined wavelength in which the channel accommodating the coupling element is linear and has said predetermined cross-section.

17. An E-plane filter as claimed in claim 9, wherein the portion of said waveguide channel which accommodates at least one of said first and second coupling elements includes a part linear section and an adjacent which the first and second walls curve in said plane.

18. An E-plane filter as claimed in claim 9, wherein the portion of said waveguide channel which accommodates at least one of said first and second coupling elements includes at least two sections in which the first and second walls are curved in said plane and the radius of curvature of at least one section is different from the radius of curvature of at least one other section.

19. An E-plane filter as claimed in claim 9, wherein at least a portion of said filter channel that accommodates said first and second couplers and said resonator cavity is curved, and the radius of curvature of a center line along the curved portion of said filter channel and centered between said first and second walls is about twice the wavelength or more at one of the minimum operating frequency and the center frequency of said E-plane filter.

20. An E-plane filter as claimed in claim 9, wherein the shortest distance between said first and second ports is less than the length of said filter channel between said first and second ports.

21. An E-plane filter as claimed in claim 9, further comprising a third planar coupling element extending between said first and second walls and spaced apart along said channel from said second coupling element to form a second resonator cavity between said second and third coupling elements, and wherein said filter channel changes direction in a plane transverse to said first and second walls within a portion of said filter channel which accommodates said second resonator cavity and said third coupling element.

22. An E-plane filter as claimed in claim 9, further comprising a third port and a second waveguide filter channel extending between said first and third ports, and third and fourth planar coupling elements extending between opposed walls of said second waveguide filter channel and spaced apart along said channel to form a resonator cavity therebetween, and wherein the shortest distance between said first and third ports is less than the combined lengths of said first waveguide channel between said first and second ports and said second waveguide channel between said first and third ports.

23. An E-plane filter as claimed in claim 9, wherein said filter channel which includes a portion thereof that accommodates said first and second coupling elements and said resonator cavity turns in one sense through an angle of at least 90°.

24. An E-plane filter as claimed in claim 9, wherein said filter channel includes a portion which is directed along a first direction, another portion which turns away from said first direction and a further portion which turns towards said first direction.

25. An E-plane filter as claimed in claim 9, wherein said waveguide channel is dimensioned for passing electromagnetic energy having a frequency in the range of about 20 GHz to 40 GHz.

26. An E-plane filter as claimed in claim 9, wherein said filter channel changes direction within the length of said resonator cavity, said change in direction being defined by each of said first and second walls each being contained within at least two planes which intersect at an angle.

27. An E-plane filter as claimed in claim 26, wherein said channel changes direction at a position within said channel which accommodates a middle portion of said resonator cavity.

28. An E-plane filter as claimed in claim 26, wherein said channel has a center line directed along said channel and centered between said first and second walls, and the opposed ends of said coupling elements defining said resonator cavity are linear and intersect said center line substantially at right angles thereto.

29. An E-plane filter as claimed in claim 9, wherein the change in direction of the channel is defined by a curve in the first and second walls.

30. An E-plane filter as claimed in claim 29, wherein the center of curvature of the curve in each of the first and second walls is positioned external of said channel.

31. An E-plane filter as claimed in claim 30, wherein said channel has a predetermined cross-section and a centre line along said channel and centered between said first and second walls and the spacing between the opposed ends of said coupling elements which define said resonator cavity for passing a predetermined wavelength is determined such that the length of said center line between said ends is substantially equal to the length of the center line between opposed ends of opposed coupling elements defining a resonator cavity in an E-plane filter for passing said predetermined wavelength in which the channel accommodating the resonator cavity is linear and has said predetermined cross-section.

32. An E-plane filter as claimed in claim 9, wherein the portion of said waveguide channel which accommodates said resonator cavity includes a part linear section and an adjacent section in which the first and second walls curve in said plane.

33. An E-plane filter as claimed in claim 9, wherein the portion of said waveguide channel which accommodates said resonator cavity includes at least two sections in which the first and second walls are curved in said plane and the radius of curvature of at least one section is different from the radius of curvature of at least one other section.

34. An E-plane filter comprising a housing having first and second housing sections each having a channel therein, said channels being positioned opposite one another to form a waveguide filter channel extending between first and second ports and for passing electromagnetic energy between said ports, a plurality of coupling elements positioned between said first and second housing sections and extending between opposed first and second walls of said waveguide filter channel, and spaced apart along said channel to form a resonator cavity between adjacent coupling elements, wherein said waveguide filter channel changes direction in a plane directed along said channel and transverse to said first and second walls, and within a portion of said filter channel which accommodates said plurality of coupling elements and each resonator cavity.

35. An E-plane filter comprising a housing having first and second ports and a waveguide filter channel extending between said ports and for passing electromagnetic energy between said ports, said waveguide channel being defined by opposed first and second walls and opposed third and fourth walls connecting said first and second walls, a plurality of coupling elements extending between said opposed first and second walls and positioned to form a partition between said third and fourth walls, said coupling elements being spaced apart along said channel to form a resonator cavity between adjacent coupling elements, wherein said waveguide filter channel changes direction in a plane directed along said channel and transverse to said first and second walls, and within a portion of said filter channel which accommodates said plurality of coupling elements and each resonator cavity.

36. An E-plane filter as claimed in claim 35, wherein the change in direction of the channel is defined by a curve in the first and second walls.

37. An E-plane filter as claimed in claim 36, wherein said channel has a centre line directed along said channel and centered between the first and second walls, and the opposed ends of said coupling elements defining each resonator cavity are linear and intersect said center line substantially at right angles thereto.

38. A method of forming a septum for an E-plane filter in which the filter has a waveguide channel which changes direction within the length of a resonator cavity, the method comprising the steps of:

(1) determining the length of a gap between the ends of opposed couplers based on an E-plane filter in which a resonator cavity between said couplers is accommodated in a linear waveguide channel, and (2) forming the ends of said opposed couplers based on an E-plane filter having a waveguide channel that changes direction within the length of said resonator cavity such that the length of the center line along the waveguide channel between the ends of said couplers substantially corresponds to the length of said gap determined in step (1).

39. A method as claimed in claim 38, wherein step (2) includes forming said ends at an angle to one another.

40. A method as claimed in claim 38, further comprising forming the ends such that the ends are substantially linear.

41. A method as claimed in claim 40, further comprising the step of forming the ends such that the ends intersect said center line substantially at right angles thereto.

42. A method as claimed in claim 38, wherein step (1) comprises determining the length of said gap based on said linear waveguide channel having the same cross-section as the waveguide channel which changes direction and the E-plane filter with the linear channel having the same frequency filtering characteristics as the E-plane filter having the waveguide channel which changes direction.

43. A method as claimed in claim 42, further comprising the steps of forming a second septum for a second E-plane filter having a waveguide channel which changes direction and which corresponds to the waveguide channel of the first E-plane filter, including:

(a) determining the length of a gap between the ends of opposed couplers based on an E-plane filter in which a resonator cavity between said couplers is accommodated in a linear waveguide channel to provide different frequency filtering characteristics to those of the first E-plane filter; and (b) forming the ends of the opposed couplers for said second E-plane filter such that the length of the centre line along the waveguide channel between the ends of said couplers corresponds to the length of said gap determined in step (a).

44. A method of forming a septum for an E-plane filter in which the filter has a channel which changes direction within the length of a coupler, the method comprising the steps of:

(1) determining the distance between the opposed ends of a coupler based on an E-plane filter in which the coupler is accommodated within a linear waveguide channel, and (2) forming the ends of said coupler based on a waveguide having a channel that changes direction within the length of said coupler such that the length of the center line along said channel between the ends of the coupler substantially corresponds to the length between the ends determined in step (1).

45. A method as claimed in claim 44, wherein step (2) comprises forming said ends at an angle to one another.

46. A method as claimed in claim 44, comprising forming the ends of the coupler such that the ends are substantially linear.

47. A method as claimed in claim 46, comprising forming the ends of the coupler such that the ends intersect the center line substantially at right angles thereto.

48. A method as claimed in claim 44, wherein said distance is determined based on said linear waveguide channel having the same cross-section as the waveguide channel which changes direction and the E-plane filter with the linear channel having the same frequency filtering characteristics as the E-plane filter having the waveguide channel which changes direction.

49. A method as claimed in claim 48, further comprising the steps of forming a second septum for a second E-plane filter having a waveguide channel which changes direction and which corresponds to the waveguide channel of the first E-plane filter, including:

(a) determining the distance between the opposed ends of a coupler based on an E-plane filter in which said coupler is accommodated in a linear waveguide channel to provide different frequency filtering characteristics to those of the first E-plane filter; and (b) forming the opposed ends of the coupler for said second E-plane filter such that the length of the centre line along the waveguide channel between the ends of said coupler corresponds to the distance determined in step (a).

50. A method of forming a housing section for an E-plane filter, comprising the steps of:

(1) defining a waveguide filter channel to be formed in said housing section for passing electromagnetic energy therethrough, the filter channel having opposed walls and a portion of the filter channel, which, in use, accommodates a plurality of sheet coupling elements directed along and extending across said channel and a resonator between adjacent coupling elements, changes direction in a plane transverse to said opposed walls, and (2) forming said housing section with said waveguide filter channel.

51. A method of forming a housing section for an E-plane filter as claimed in claim 50, further comprising forming a plurality of said housing sections, wherein the change in direction of each channel is defined by a curve in the first and second walls, at least a portion of the curved portion of each channel being identical to one another, and forming first and second spaced apart coupling elements for each housing section and positioning said coupling elements across the channel of each housing section such that the position of at least one of the first and second couplers of one housing section relative to the curved portion is different from that of the respective coupling elements in each of the other housing sections.

52. A method of forming a housing section for an E-plane filter as claimed in claim 50, further comprising designing a cast for use in the production of said housing section including:

defining a formation for said cast to form said waveguide filter channel defined in step (1), and forming a cast which includes said formation and using said cast in step (2) to form said housing section.

* * * * *